US006903621B2

(12) United States Patent
Malcolm et al.

(10) Patent No.: US 6,903,621 B2
(45) Date of Patent: Jun. 7, 2005

(54) IN-LINE ATTENUATOR

(75) Inventors: Bruce G. Malcolm, Fishers, IN (US); Dexin Sun, Indianapolis, IN (US)

(73) Assignee: Trilithic, Inc., Indianapolis, IA (US)

( * ) Notice: Subject to any disclaimer, the term of this patent is extended or adjusted under 35 U.S.C. 154(b) by 0 days.

(21) Appl. No.: 10/441,701

(22) Filed: May 20, 2003

(65) Prior Publication Data

US 2004/0233011 A1 Nov. 25, 2004

(51) Int. Cl.[7] ..... H01P 1/22
(52) U.S. Cl. ..... 333/81 A; 333/22 R; 333/12
(58) Field of Search ..... 333/22 R, 33, 333/81 A, 246, 172; 330/144, 69

(56) References Cited

U.S. PATENT DOCUMENTS 4,383,227 A * 5/1983 de Ronde ..... 333/22 R
5,317,663 A * 5/1994 Beard et al. ..... 385/70
5,450,046 A * 9/1995 Kosugi et al. ..... 333/26
6,373,348 B1 * 4/2002 Hagerup ..... 333/81 A
6,472,948 B1 * 10/2002 Kyriakos et al. ..... 333/81 R
6,477,154 B1 * 11/2002 Cheong et al. ..... 370/328

* cited by examiner

*Primary Examiner*—Jean Jeanglaude
*Assistant Examiner*—Lam T. Mai
(74) *Attorney, Agent, or Firm*—Barnes & Thornburg LLP

(57) ABSTRACT

An attenuator includes a substrate having first and second surfaces and a plurality of discrete circuit elements. The first surface includes a first electrically conductive pattern providing circuit contacts providing electrical connections among the discrete circuit elements and circuit contacts providing electrical connections to components external to the attenuator. The second surface includes a second electrically conductive pattern.

27 Claims, 36 Drawing Sheets

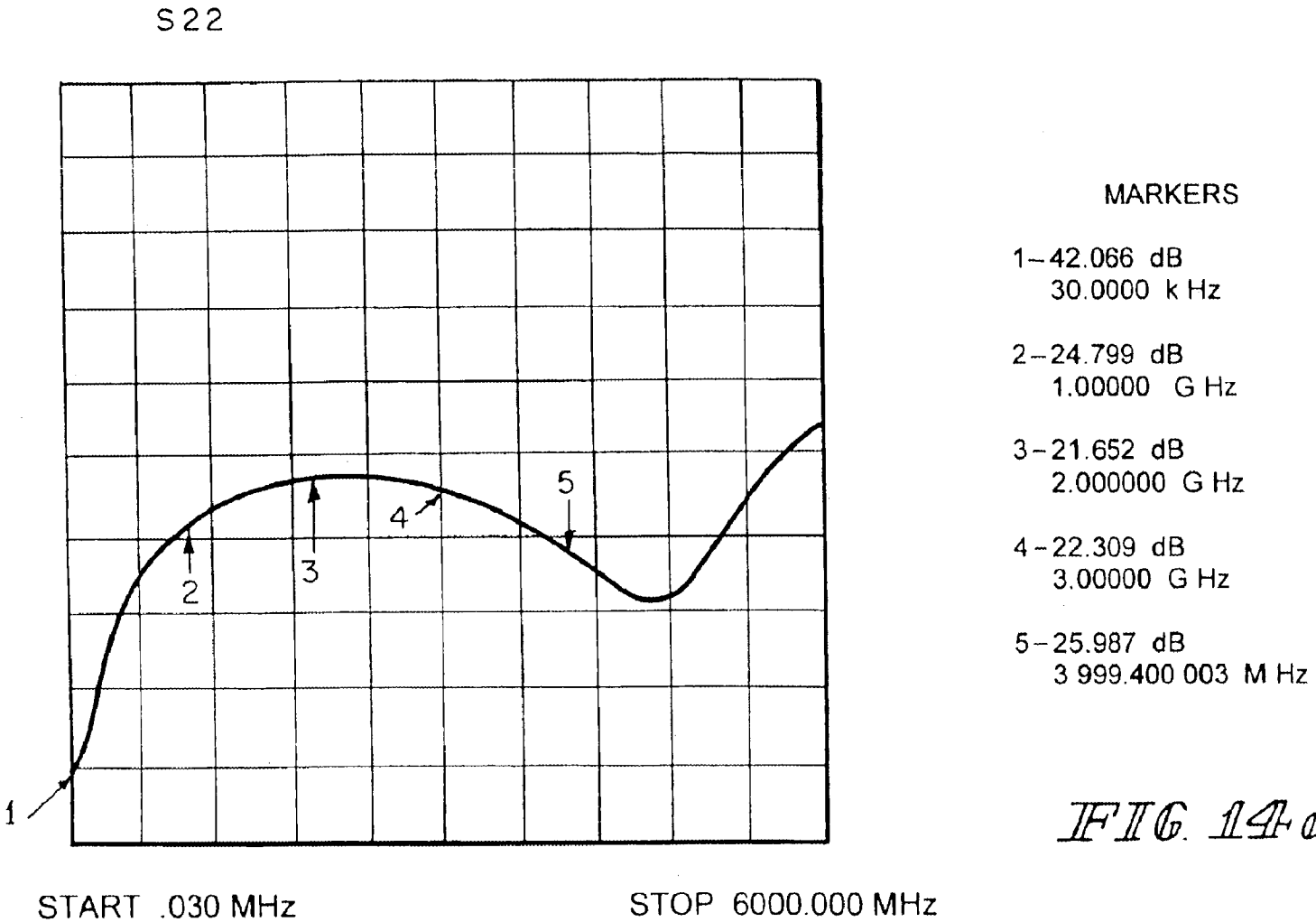
FIG. 14A d

IN-LINE ATTENUATOR

FIELD OF THE INVENTION

This invention relates to electrical components, and particularly to attenuators. It is disclosed in the context of a microstrip, stripline, or the like, attenuator. However, it is believed to be useful in other applications as well.

1. Background of the Invention

Various types of attenuators are known. There are, for example, the attenuators illustrated in PCT/US01/43204, assigned to the same assignee as this application. The disclosure of PCT/US01/43204 is hereby incorporated herein by reference. There are also the various types of attenuators illustrated and described at http://www.metcladinternational.com/reference/Microstrip%20Lines/Microstrip.htm, the disclosure of which is hereby incorporated herein by reference. No representation is intended by this listing that a thorough search of all material prior art has been conducted, or that no better art than that listed is available, or that the listed items are material to patentability. Nor should any such representation be inferred.

2. Disclosure of the Invention

According to the invention, an attenuator includes a substrate having first and second surfaces and a plurality of discrete circuit elements. The first surface includes a first electrically conductive pattern providing circuit contacts providing electrical connections among the discrete circuit elements, and circuit contacts providing electrical connections to components external to the attenuator. The second surface includes a second electrically conductive pattern.

Illustratively according to an aspect of the invention, the apparatus further includes a housing for the attenuator. The circuit contacts providing electrical connections to components external to the attenuator include connectors for coupling electrically to complementary connectors provided on the housing.

Illustratively, according to an aspect of the invention, the housing includes a BNC connector and the circuit contacts include connectors for coupling electrically to respective terminals of the BNC connector.

Illustratively according to an aspect of the invention, the housing includes an SMA connector and the circuit contacts include connectors for coupling electrically to respective terminals of the SMA connector.

Illustratively according to an aspect of the invention, the substrate includes a third surface between the first and second surfaces. The third surface includes an electrically conductive portion coupled to at least one of the first and second electrically conductive patterns. The apparatus further includes a connector for coupling the electrically conductive portion of the third surface to the housing.

Illustratively according to an aspect of the invention, the attenuator comprises a microstrip attenuator.

Illustratively according to an aspect of the invention, the substrate comprises fiber-reinforced resin.

BRIEF DESCRIPTION OF THE DRAWINGS

The invention may best be understood by referring to the following detailed descriptions and accompanying drawings which illustrate the invention. In the drawings:

FIGS. 7*a–b* illustrate plan views of details of devices constructed according to the invention;

DETAILED DESCRIPTION OF ILLUSTRATIVE EMBODIMENTS

Figure 1:
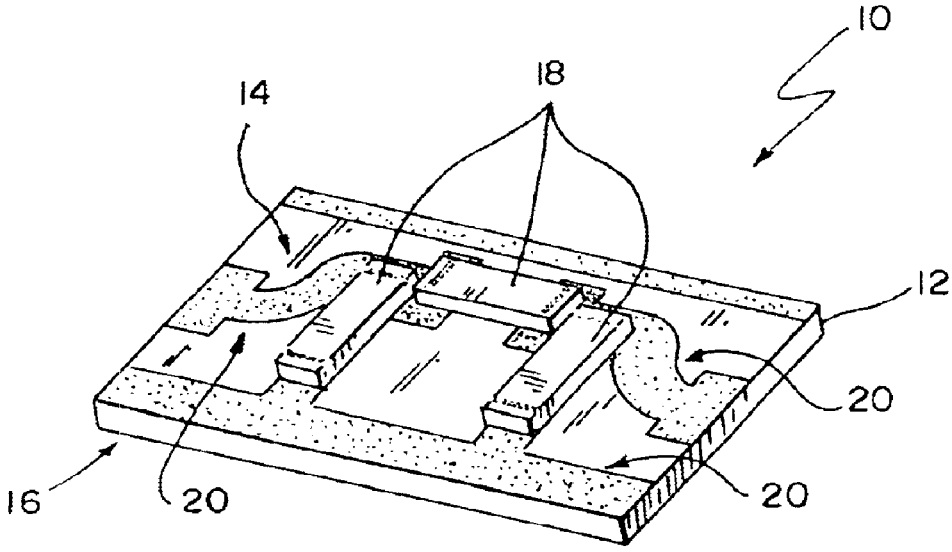
FIG. 1 illustrates a perspective view of a device constructed according to the invention.
Figure 2:
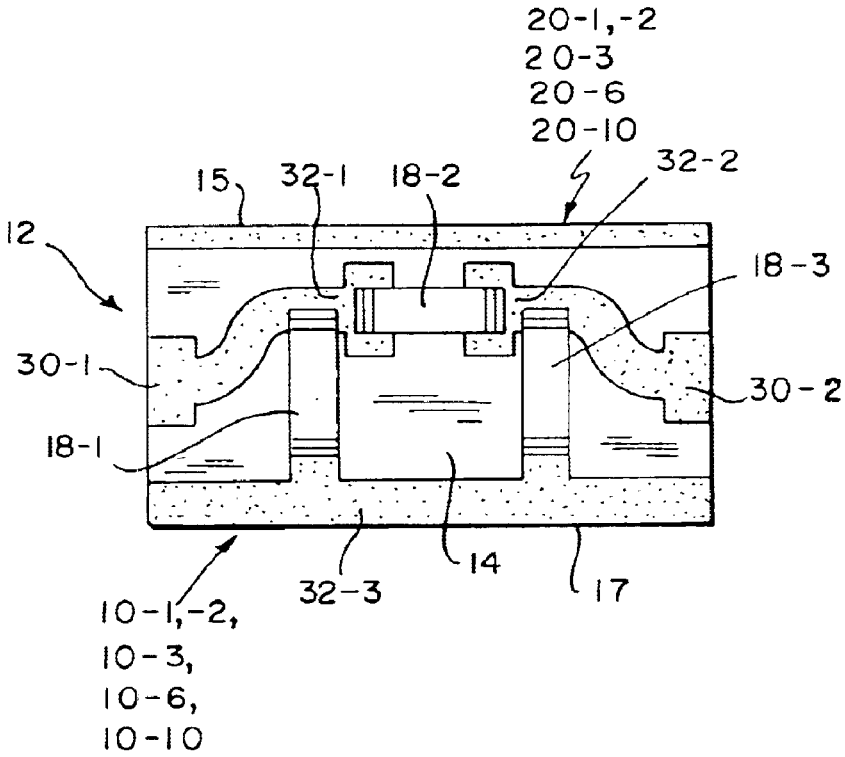
FIG. 2 illustrates a plan view of a device constructed according to the invention.
Figure 3:
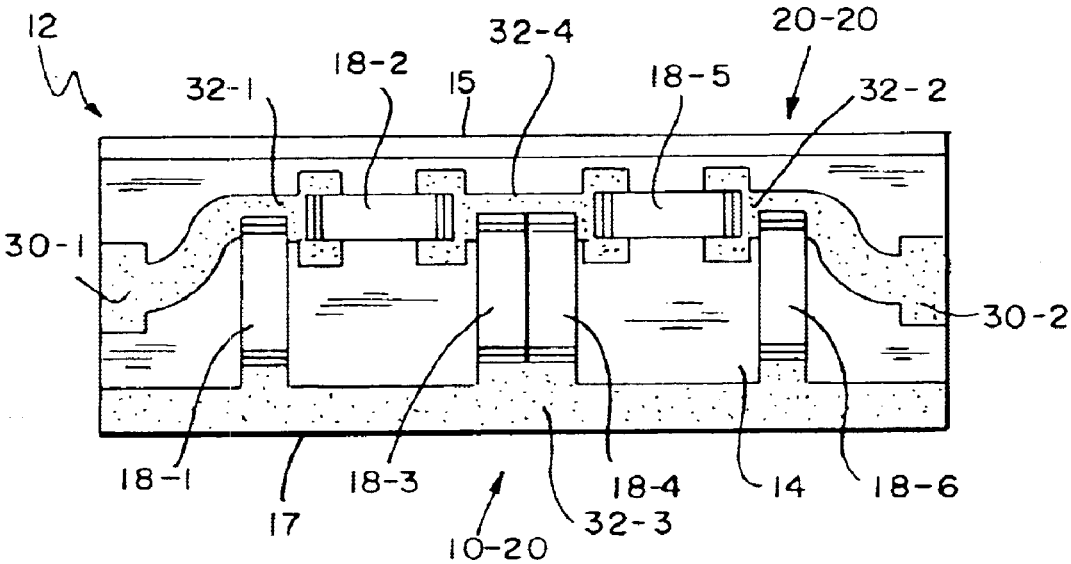
FIG. 3 illustrates a plan view of a device constructed according to the invention.

Referring now to FIG. 1, a microstrip attenuator 10 includes a substrate 12, having a front surface 14 and a back surface 16, longitudinal edges 15 and 17 between surfaces 14 and 16, and a plurality of chip resistors 18. Illustratively, substrate 12 is constructed using FR4. FR4 is a fairly ubiquitous, non-low loss, epoxy resin-impregnated fiberglass. Constructing the substrate 12 using FR4 may provide cost benefits Alternatively, substrate 12 may be composed of one of several common dielectric materials known to those of ordinary skill in the art. The front surface 14, back surface 16, and edges 15, 17 are coated with conductive films using any suitable method such as, for example, plating or vapor deposition of metal film. The method used may depend in part on the material from which the substrate 12 is constructed. The coating of the surfaces 14, 15, 16, 17 creates on each of surfaces 14, 15, 16, 17 a continuous electrically conductive film such as, for example, a copper or other metal or metal composite film. A pattern 20, 22, respectively, of the conductive film (shaded areas in FIGS. 4*a–b*, 5*a–b*, 6*a–b*, 7*a–b* and 8*a–b*) is then created on each of surfaces 14, 16, by any suitable means, for example, chemically etching. The film on edges 15, 17 may be left intact and remain electrically connected to the adjacent remaining film pattern 20, 22 on one or the other or both of surfaces 14, 16. The pattern 20, 22 generation forms electrically conductive circuit traces 20 on the surface 14 and a patterned ground plane 22 on surface 16.

In other embodiments, the film on edges 15, 17 and the conductive film traces 20 and patterned ground plane 22 may be applied by painting or printing of conductive material, selective application of conductive tape, or any other suitable technique. This eliminates the step(s) associated with removing the film from areas where it is not desired.

The resistors 18 are soldered or otherwise electrically coupled to conductive pads of the circuit traces 20 of the front surface 14. The resistors 18 are coupled to the traces 20 to create an attenuator 10 for attenuating electrical signals in an electrical circuit into which the attenuator 10 is subsequently coupled.

The circuit traces 20 of the front surface 14 include connector pin interface pads 30-1 and 30-2 and resistor pads 32-1, 32-2, 32-3 and, in the embodiment of FIGS. 3 and 8*a–b*, 32-4. The conductive pads 30-1, 30-2 and 32-3 provided points for coupling the attenuator 10 to external circuitry. Specifically, pad 30-1 and pad 32-3 provide an input or output to/from the attenuator 10 and pad 30-2 and pad 32-3 provide an output or input port from/to attenuator 10. Pads 32-1, 32-2 and 32-3 and, in the embodiment of FIGS. 3 and 8*a–b*, 32-4, provide the connection points for the resistors 18 that provide the attenuation provided by attenuator 10. The illustrative circuit traces 20 with their pads 30-1, 30-2, 32-1, 32-2, 32-3, 32-4 are configured for three resistors 18-1, 18-2, 18-3, or, in the embodiment of FIGS. 3 and 8*a–b*, six resistor 18-1, 18-2, 18-3, 18-4, 18-5, 18-6, "Π" attenuator networks. However, the illustrated and described technology is also adaptable to other types of attenuators including, for example, types having other numbers of resistors or other network configurations. In each case, by proper selection of the values of the resistors 18, a desired amount of attenuation can be provided by attenuator 10.

Figure 8A:
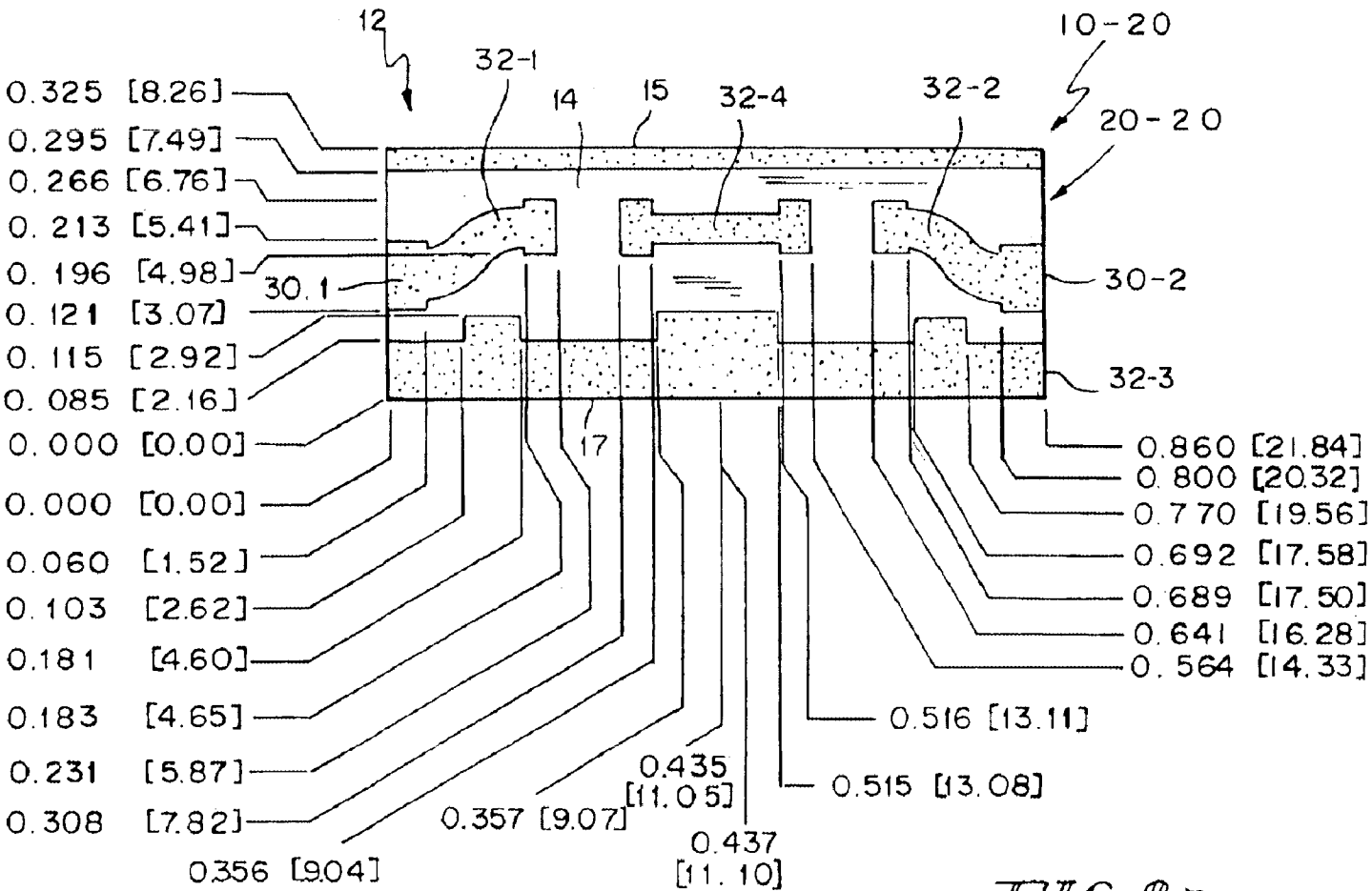
FIGS. 8*a–b* illustrate plan views of details of device constructed according to the invention.
Figure 8B:
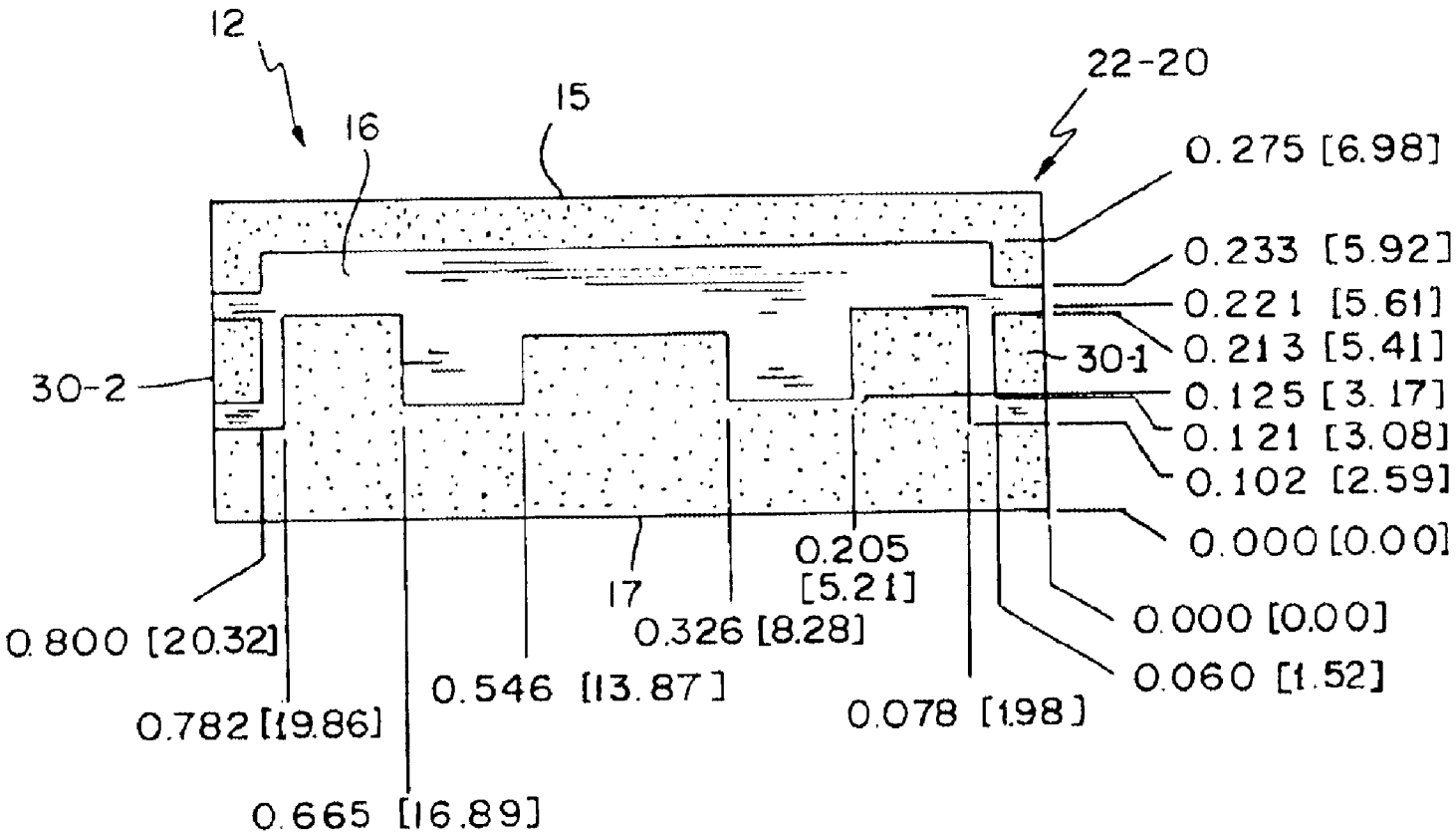

As best illustrated in FIGS. 4*a*, 5*a*, 6*a*, 7*a* and 8*a*, in plan view, the substrate 12 of each attenuator 10-1, –2, 10-3, 10-6, 10-10 and 10-20 is generally rectangular in shape. Illustratively, each attenuator 10 has a width of about 0.325 inch (about 8.26 mm). Attenuators 10-1, –2 illustrated in FIGS. 4*a–b*, and attenuators 10-3, 10-6 and 10-10 illustrated in FIGS. 5*a–b*, 6*a–b* and 7*a–b*, respectively, illustratively have lengths of 0.62 inch (about 15.75 mm). Attenuator 10-20 illustrated in FIGS. 8*a–b* illustratively has a length of 0.86 inch (about 21.84 mm). However, the lengths, widths, and shapes are clearly within the scope of the invention. Other dimensions of the traces 20-1, –2, 20-3, 20-6, 20-10 and 20-20 and the ground plane patterns 22-1, –2, 22-3, 22-6, 22-10 and 22-20 of attenuators 10-1, –2, 10-3, 10-6, 10-10 and 10-20, respectively, are as noted in inches (mm in parenthesis) in FIGS. 4*a–b*, 5*a–b*, 6*a–b*, 7*a–b* and 8*a–b*, respectively, referenced to a corner designated 0.0 of the substrate 12-1, –2, 12-3, 12-6, 12-10 and 12-20, respectively.

Figure 4A:
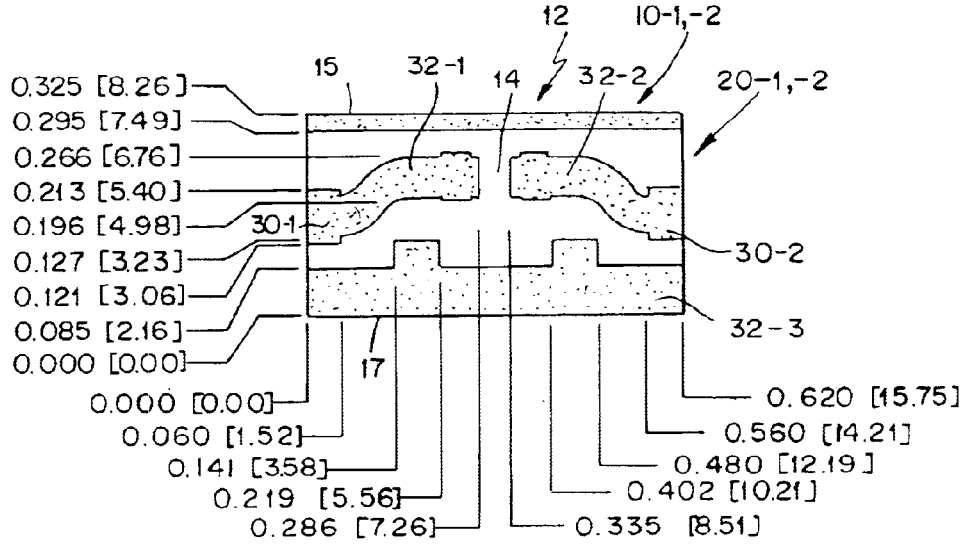
FIGS. 4*a–b* illustrate plan views of details constructed according to the invention.
Figure 4B:
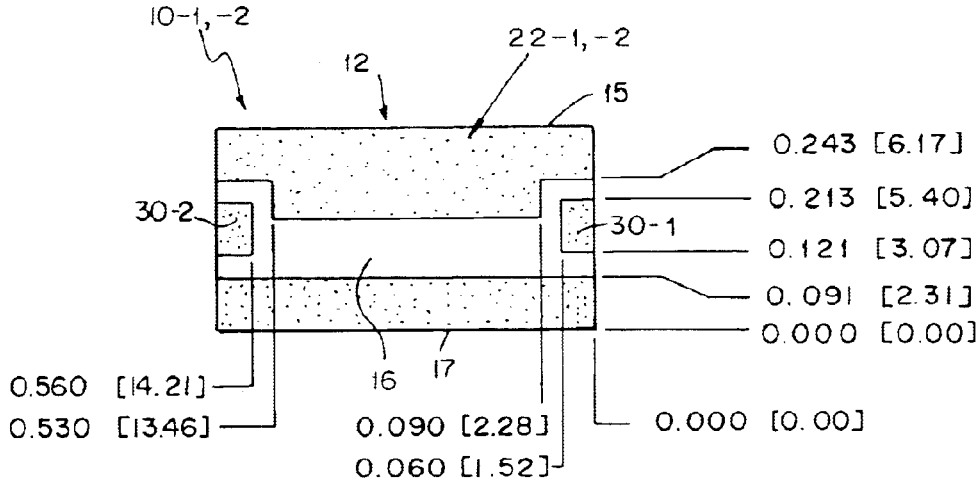
Figure 5A:
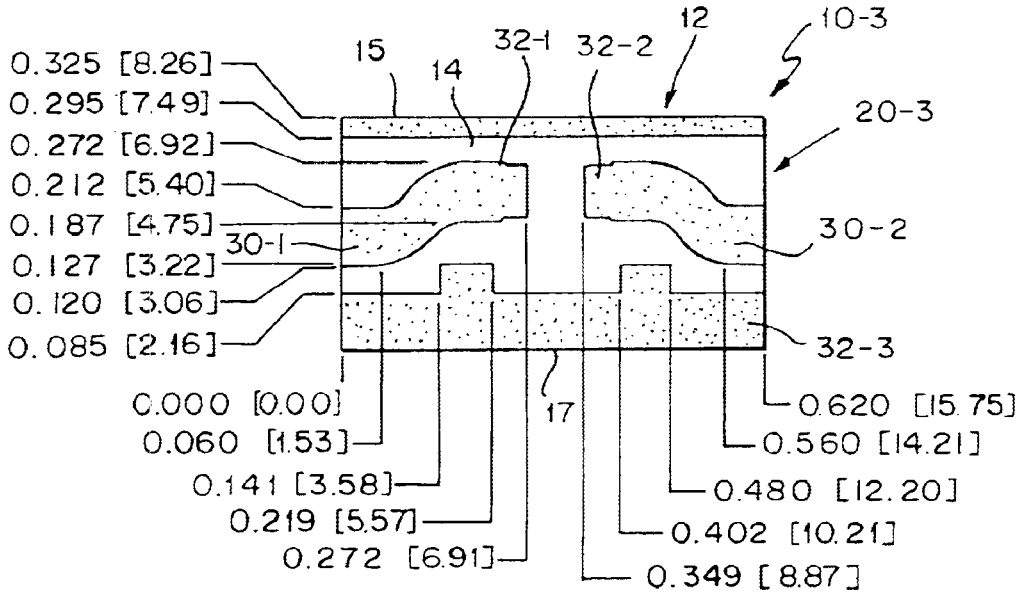
FIGS. 5*a–b* illustrate plan views of details constructed according to the invention.
Figure 5B:
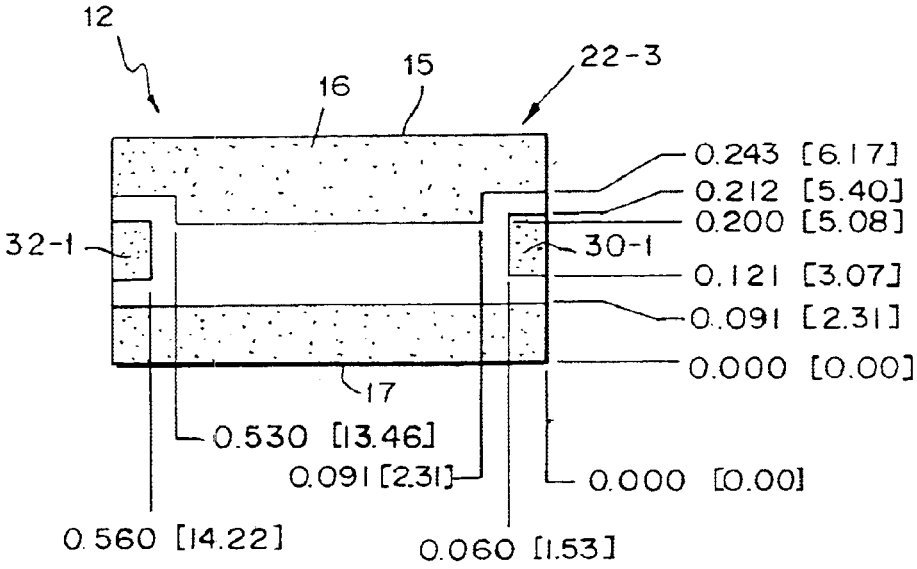
Figure 6A:
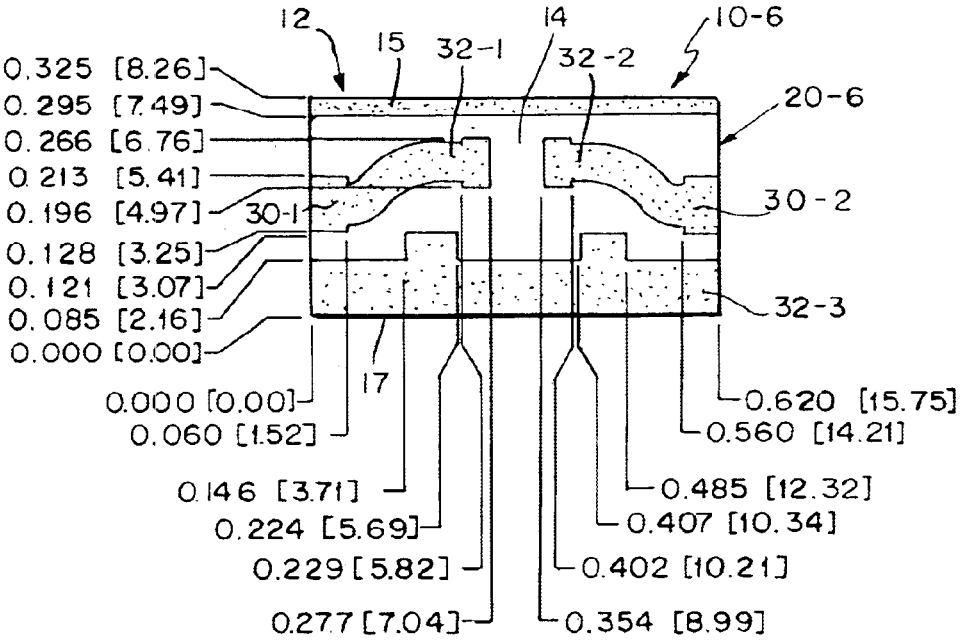
FIGS. 6*a–b* illustrate plan views of details constructed according to the invention.
Figure 6B:
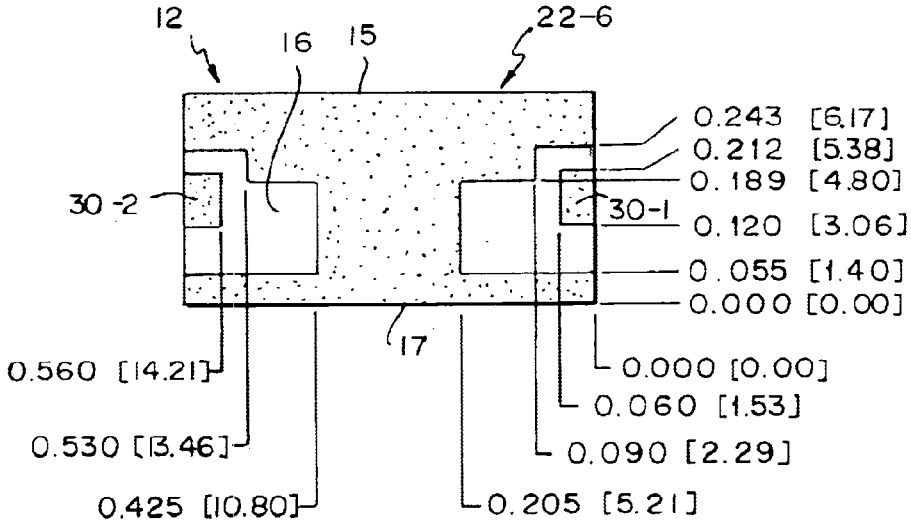
Figure 1A:
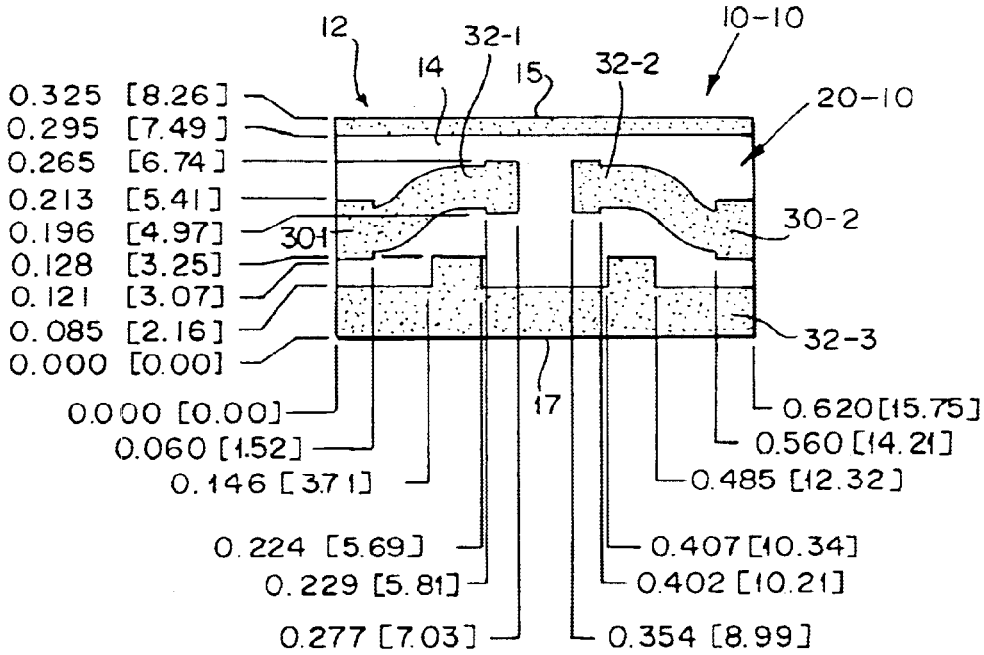
Figure 1B:
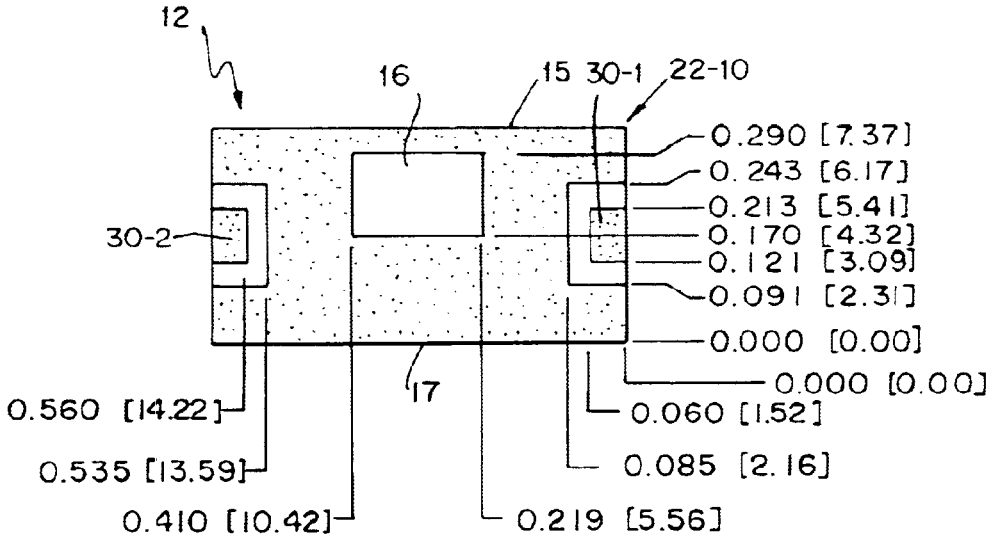

In an attenuator 10, the circuit traces 20 of the front surface 14 are generally as illustrated in FIGS. 4*a*, 5*a*, 6*a*, 7*a* and 8*a*. Due at least in part to distributed parasite circuit parameters, such as parasitic capacitance, of such traces 20 at the frequencies of operation at which these types of devices are sometimes used, the ground plane on the back surface 16 is patterned 22. The pattern 22 depends upon the desired attenuation. FIG. 4*b* illustrates a ground plane pattern 22-1, –2 useful for attenuators 10-1, 10-2 useful for providing 1 or 2 decibels (dB), respectively, of attenuation (the same pattern 22-1, -31–2 is used to construct attenuators 10-1 and 10-2 having 1 dB and 2 dB of attenuation, respectively). FIG. 5*b* illustrates a ground plane pattern 22-3 useful for attenuators 10-3 useful for providing 3 dB attenuation. FIG. 6*b* illustrates a ground plane pattern 22-6 useful for attenuators 10-6 useful for providing 6 dB attenuation. FIG. 7*b* illustrates a ground plane pattern 22-10 useful for attenuators 10-10 useful for providing 10 dB attenuation. FIG. 8*b* illustrates a ground plane pattern 22-20 useful for attenuators 10-20 useful for providing 20 dB attenuation.

Each back surface 16 includes ground plane pattern 22 and pin connector pads 30-1 and 30-2 corresponding in location to pin connector pads 30-1 and 30-2, respectively, on front surface 14. The ground plane pattern 22-1, 22-3, 22-6, 22-10, 22-20 varies according to the amount of attenuation, 1 or 2 dB, 3 dB, 6 dB, 10 dB and 20 dB, respectively, which the attenuator 10 is constructed to provide. The ground plane pattern 22-1, –1, 22-3, 22-6, 22-10, 22-20 accounts for the effects of these parasite circuit parameters of the attenuator 10-1, 10-2, 10-3, 01-6, 10-10, 10-20 at the frequencies at which the attenuator 10-1, 10-2, 10-3, 10-6, 10-10, 10-20 is to operate, providing the desired accuracy to attenuator 10-1, 10-2, 10-3, 10-6, 10-10, 10-20. Locating the pin pads 30-1, 30-2 generally along a center line of the substrate 12 promotes a reasonably stable mounting geometry for attenuation 10. As illustrated, the pin connector pads 30-1 and 30-2 on surface 16 are electrically isolated from the respective ground plane pattern 22.

Figure 9:
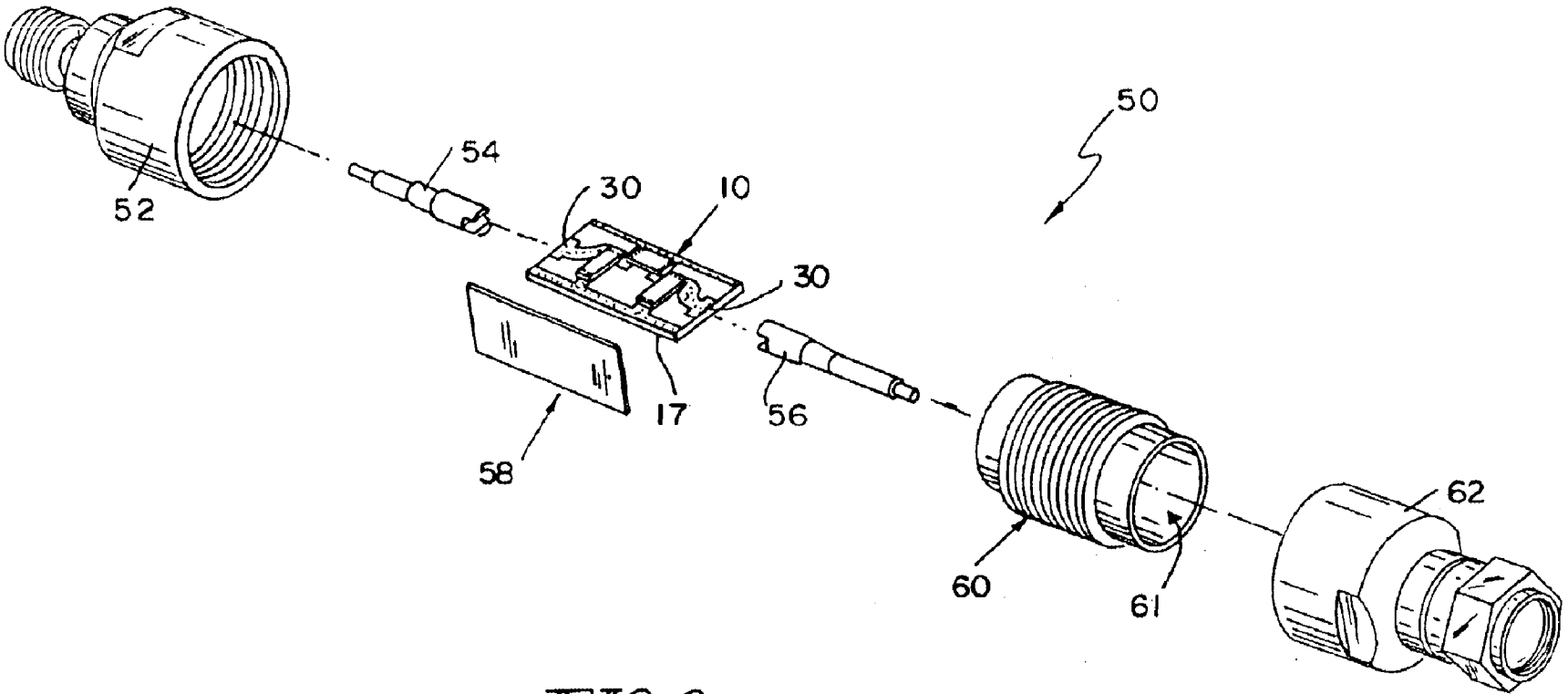
FIG. 9 illustrates an exploded perspective view of a device constructed according to the invention.
Figure 10:
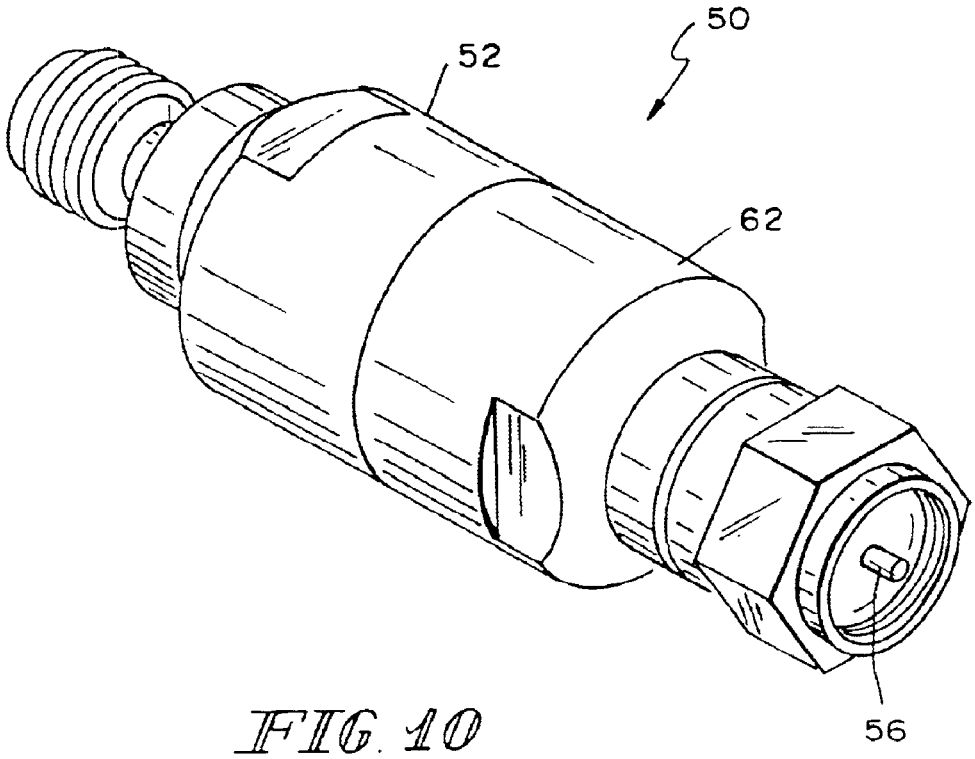
FIG. 10 illustrates an assembled perspective view of the device illustrated in FIG. 9.

There are numerous applications for attenuator 10. For example, and as illustrated in FIGS. 9–10, attenuator 10 may be integrated into an SMA connector 50. Connector 50 includes an SMA jack 52, a pin 54, a strip 58 of resilient springy metal such as beryllium copper, phosphor bronze, or the like, an attenuator 10 providing the desired attenuation, a pin 56, a fixed pad enclosure 60, and an SMA plug 62. Pins 54, 56 include slotted heads by which they are soldered or otherwise attached to respective pads 30-1, 30-2 of the attenuator 10. Illustratively, pins 54, 56 are soldered to pads 30-1, 30-2 on both the front 14 and back 16 of substrate 12 for mechanical stability and strength. Illustratively, pins 54, 56 extend along the center line of the assembled jack 52 and plug 62. Spring strip 58 helps to promote electrical contact between pad 32-3 and enclosure 60 and between portions of pattern 22 which are to be at reference potential and enclosure 60. This provides the reference potential on attenuator 10, typically through enclosure 60, and jack 52 and plug 62, both of which are coupled to a shield of a coaxial cable (not shown) by which they are coupled to reference potential of external circuitry, or are mounted to an equipment chassis or frame (not shown) which is maintained at an electrical reference potential, or the like. Attenuator 10 with attached connector pins 54, 56 is inserted, along with spring strip 58, into the interior 61 of enclosure 60. Jack 52 and plug 62 are then screw threaded onto enclosure 60. This results in an SMA connector 50 with an integrated attenuator 10, illustrated in FIG. 10.

Figure 11:
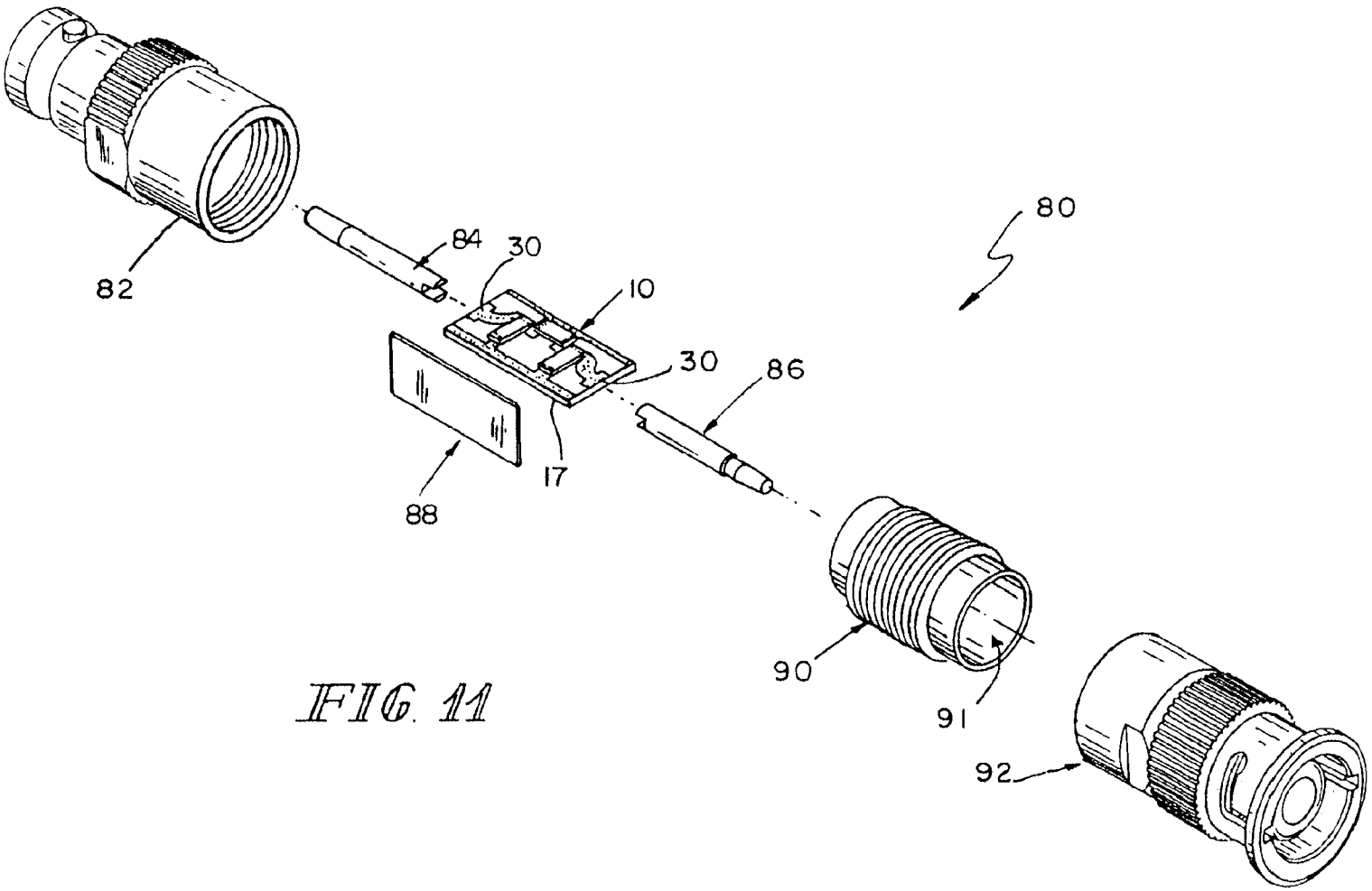
FIG. 11 illustrates an exploded perspective view of a device constructed according to the invention.
Figure 12:
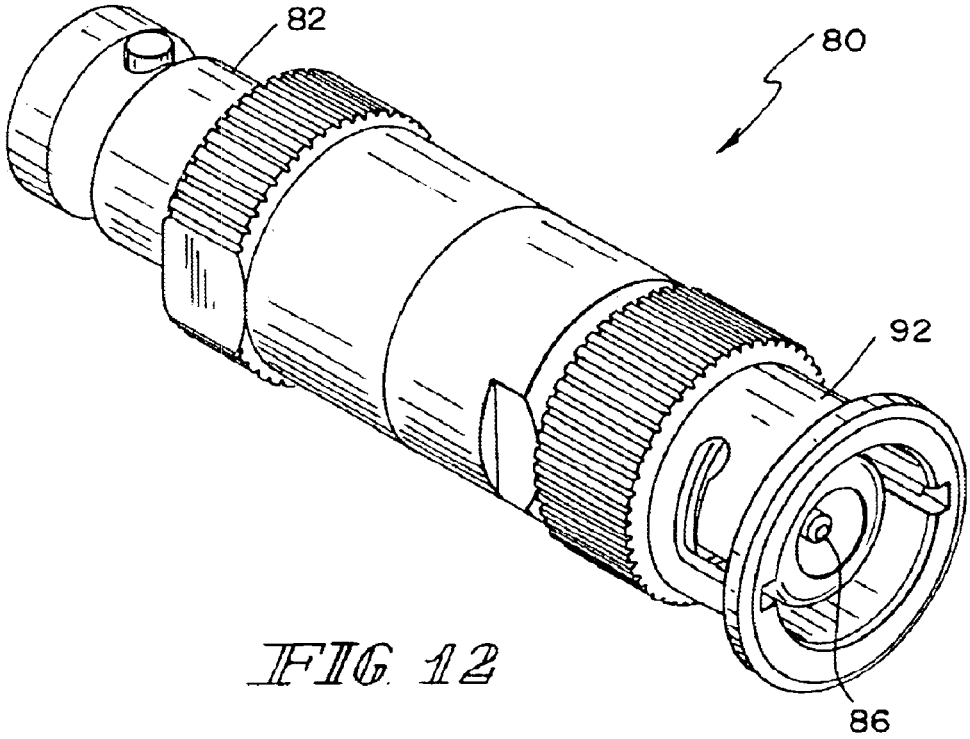
FIG. 12 illustrates an assembled perspective view of the device illustrated in FIG. 11; and, FIGS. 13*a–d* through 18*a–d* illustrate performance characteristics of various devices constructed according to the invention.

Another application for attenuator 10 is the integration of attenuator 10 into a typical BNC connector 80, as illustrated in FIGS. 11–12. Connector 80 includes a BNC jack 82, a pin 84, a strip 88 of resilient springy metal such as beryllium copper, phosphor bronze, or the like, attenuator 10, a pin 86, a fixed pad enclosure 90, and a BNC plug 92. Assembly of the BNC connector 80 with an integrated attenuator 10 is similar to the assembly of the SMA connector 50 described above. Pins 84, 86 are soldered or otherwise attached to respective pads 30-1, 30-2 of the attenuator 10. Illustratively, pins 84, 86 are soldered to respective pads 30-1, 30-2 on both the front 14 and back 16 of substrate 12 for mechanical stability and strength. Illustratively, pins 84, 86 extend along the center line of the assembled jack 82 and plug 92. Spring strip 88 helps to promote electrical contact between pad 32-3 and enclosure 90 and between portions of pattern 22 which are to be at reference potential and enclosure 90. This provides an electrical reference potential on attenuator 10, typically through enclosure 90, and jack 82 and plug 92 which are not typically electrically coupled to enclosure 90 by assembly, and both of which are coupled to a shield of a coaxial cable (not shown) by which they are coupled to reference potential of external circuitry, or are mounted to an equipment chassis or frame which is maintained at an electrical reference potential, or the like. Attenuator 10, along with the attached pins 84, 86 and spring strip 88 are inserted into the interior 91 of the fixed pad enclosure 90. BNC jack 82 and BNC plug 92 are then attached to the enclosure 90 by screwing the jack 82 and plug 92 onto the enclosure 90. The assembled BNC connector 80 with integrated attenuator 10 is illustrated in FIG. 12.

Illustrative resistor values for resistors 18-1, 18-2 and 18-3 for attenuators 10-1, 10-2, 10-3, 10-6 and 10-10 follow.

| Attenuation in dB | Value of resistor 18-1 in ohms (Ω) | Value of resistor 18-2 in Ω | Value of resistor 18-3 in Ω |
|---|---|---|---|
| 1 | 866 | 5.23 | 866 |
| 2 | 432 | 11.5 | 432 |
| 3 | 294 | 17.8 | 294 |
| 6 | 150 | 37.4 | 150 |
| 10 | 95.3 | 71.5 | 95.3 |

Attenuator 10-20 illustrated in FIGS. 8*a–b* may be thought of as two attenuators of the type illustrated in FIGS. 4*a–b*, 5*a–b*, 6*a–b* and 7*a–b* in series. Illustrative resistance values for an attenuator 10-20 providing 20 dB of attenuation include: resistor 18-1, 97.6 Ω; resistor 18-2, 71.5 Ω; resistor 18-3, 95.3 Ω; resistor 18-4, 95.3 Ω; resistor 18-5, 71.5 Ω; and resistor 18-6, 97.6 Ω.

Figure 13D:
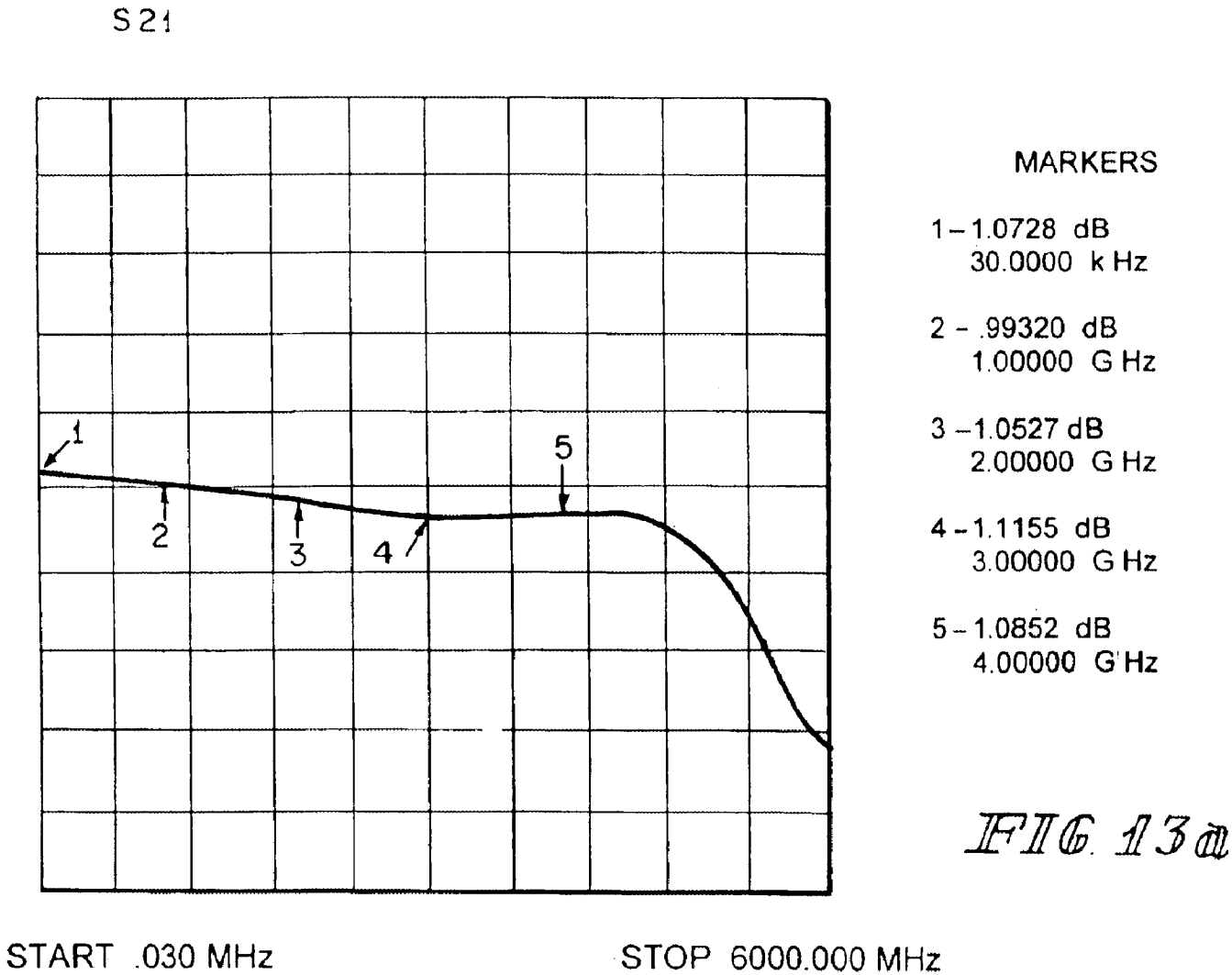

The performance of attenuator 10 of the type described, in microstrip configurations, and housed in SMA-type connectors 50 is illustrated in FIGS. 13*a–d*, 14*a–d*, 15*a–d*, 16*a–d*, 17*a–d* and 18*a–d*. FIG. 13*a* illustrates a plot of S21 (in dB) versus $\log_{10}$(frequency) of an attenuator 10-1 configured as a microstrip attenuator and designed to provide attenuation of 1 dB. S21 is the forward gain of the attenuator 10-1, which it is desired be constant at −1 dB over the frequency of interest. At 30 KHz, S21=−1.0728 dB. At 1 GHz, S21=−0.99320 dB. At 2 GHz, S21=−1.0527 dB. At 3 GHz, S21=−1.1155 dB. Finally, at 4GHz, S21=−1.0852 dB.

Figure 13B:
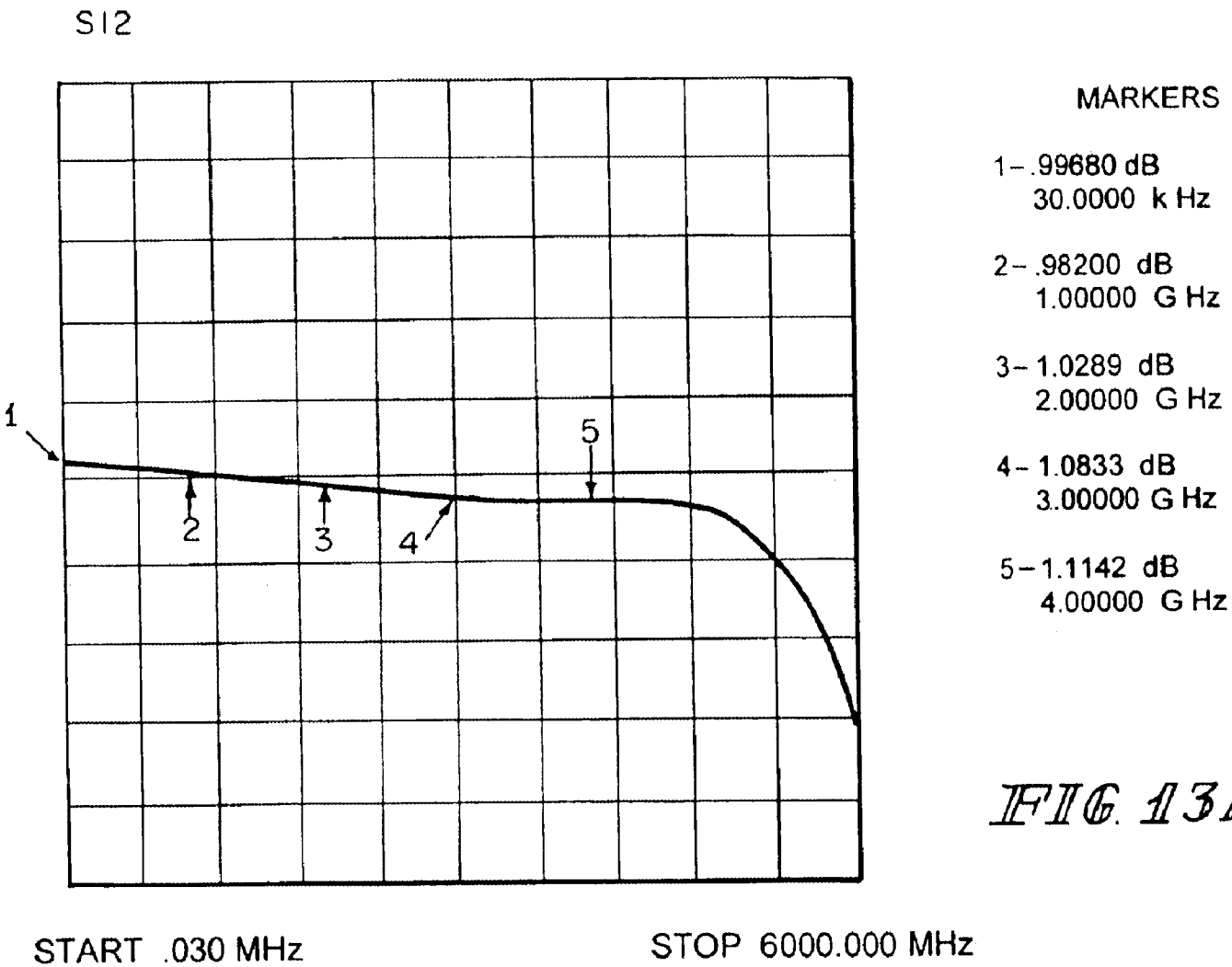

FIG. 13*b* illustrates a plot of S12 (in dB) versus $\log_{10}$ (frequency) of an attenuator 10-1 configured as a microstrip attenuator and designed to provide attenuation of 1 dB. S12 is the reverse gain of the attenuator 10-1. At 30 KHz, S12=−0.9968 dB. At 1 GHz, S12=−0.982 dB. At 2GHz, S12=−1.0289 dB. At 3 GHz, S12=−1.0833 dB. Finally, at 4 GHz, S12=−1.1142 dB.

Figure 13C:
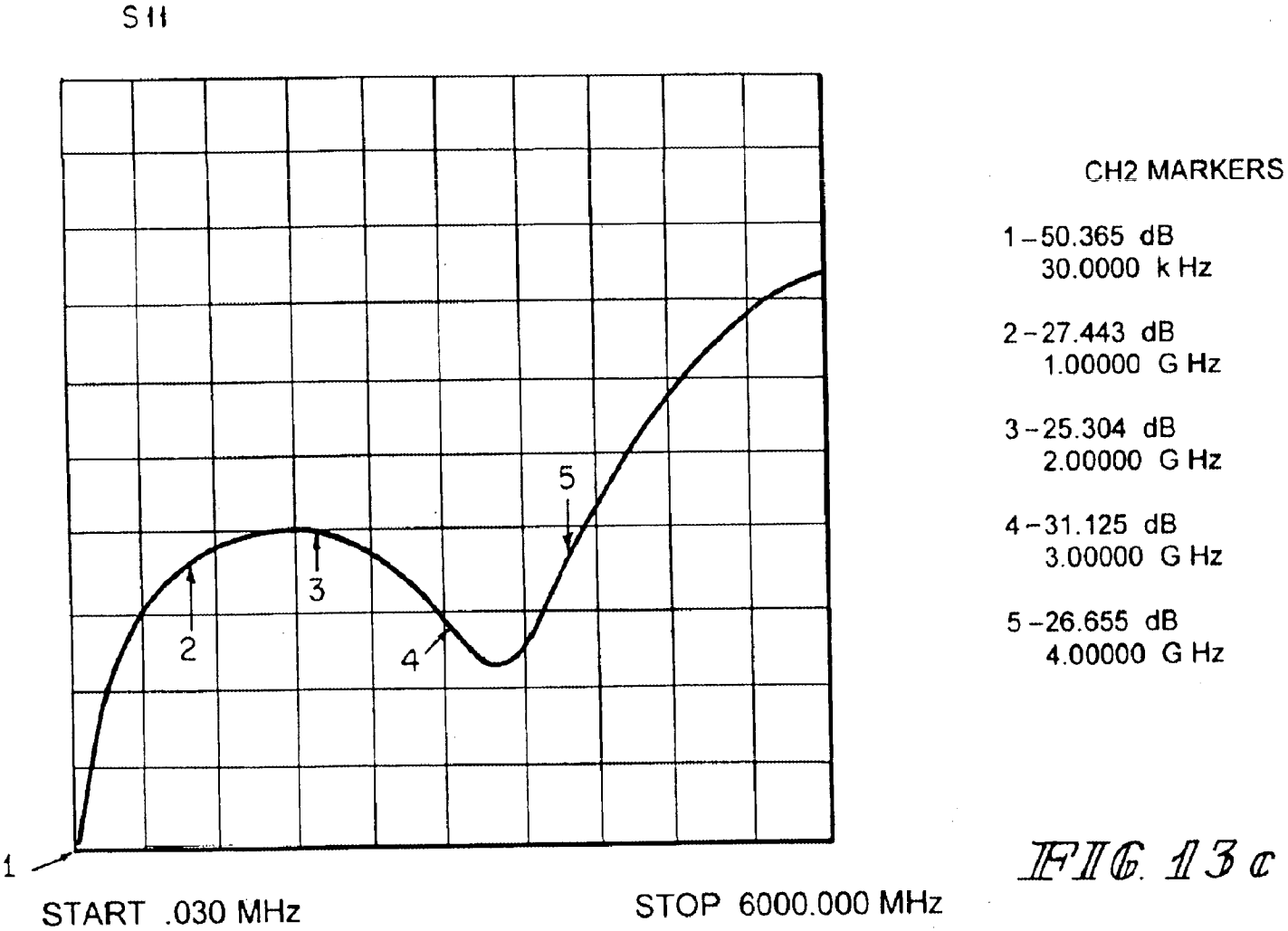
Figure 13D:
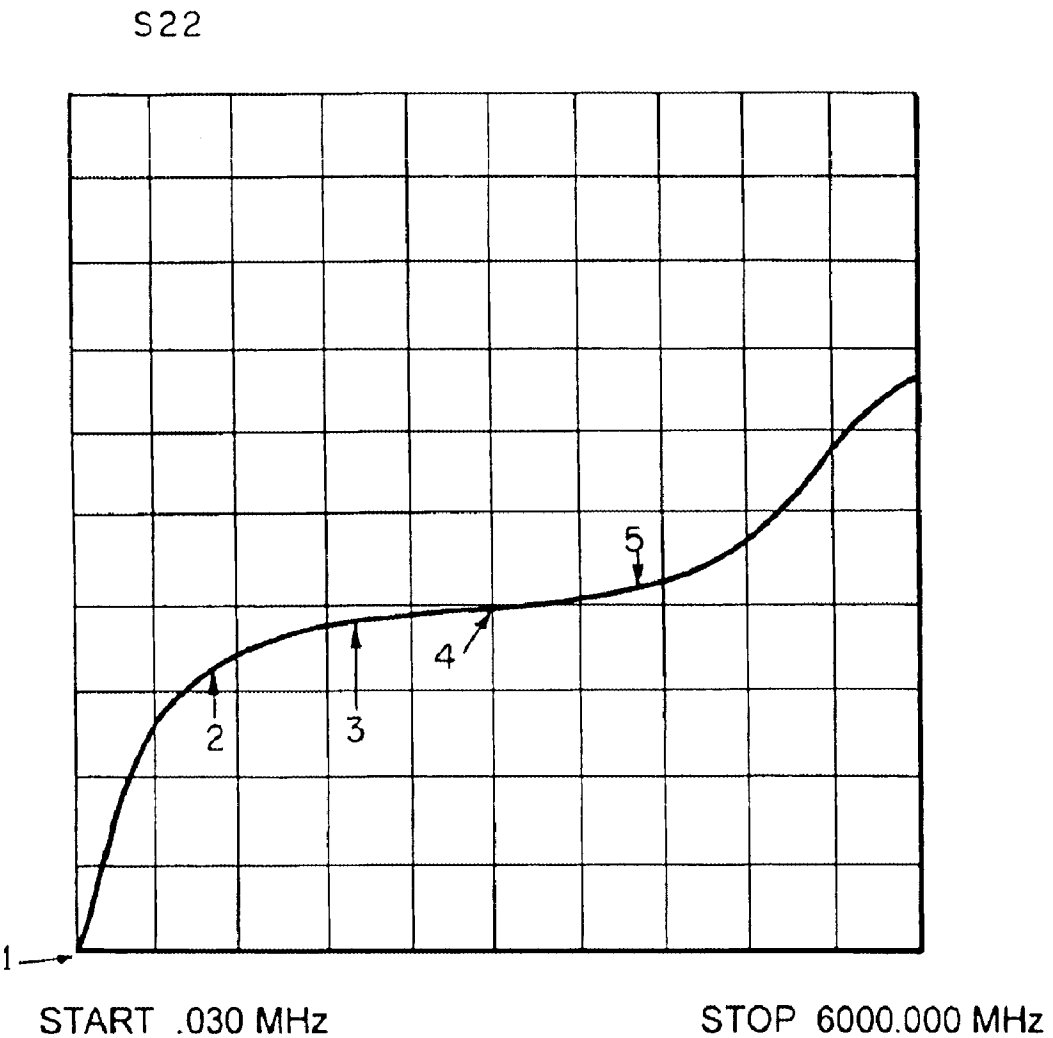

FIG. 13*c* illustrates a plot of S11 (in dB) versus $\log_{10}$ (frequency) of an attenuator 10-1 configured as a microstrip attenuator and designed to provide attenuation of 1 dB. S11 is the input reflection coefficient of the attenuator 10-1. At 30 KHz, S11=−50.356 dB. At 1 GHz, S11=−27.443 dB. At 2 GHz, S11=−25.384 dB. At 3 GHz, S11=−31.125 dB. Finally, at 4 GHz, S11=−26.655 dB.

FIG. 13*d* illustrates a plot of S22 (in dB) versus $\log_{10}$ (frequency) of an attenuator 10-1 configured as a microstrip attenuator and designed to provide attenuation of 1 dB. S22 is the output reflection coefficient of the attenuator 10-1. At 30 KHz, S22=<45.390 dB. At 1 GHz, S22=−28.493 dB. At 2 GHz, S22=−26.044 dB. At 3 GHz, S22=−25.271 dB. Finally, at 4 GHz, S22=−23.982 dB.

Figure 14A:
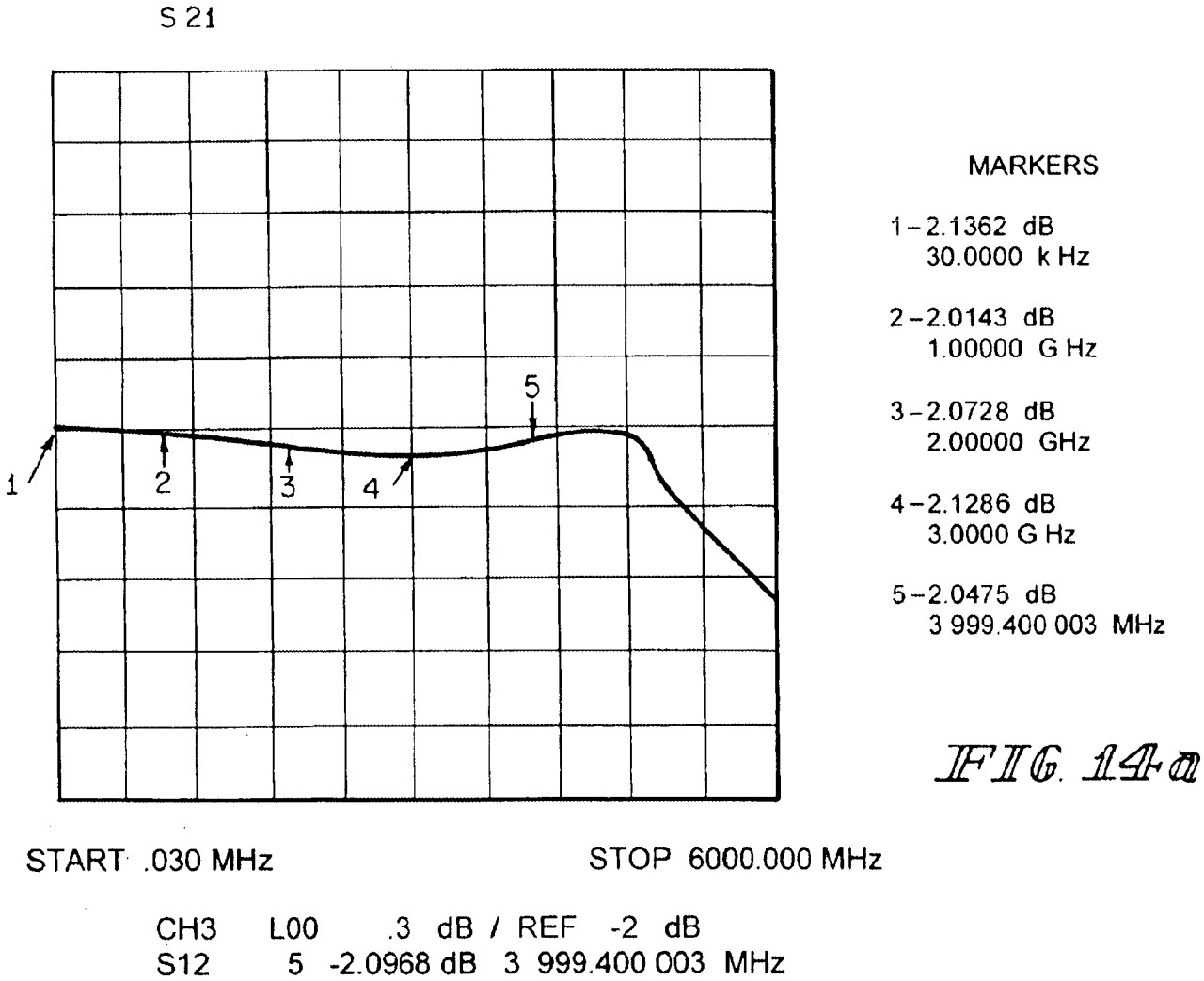

FIG. 14*a* illustrates a plot of S21 (in dB) versus $\log_{10}$ (frequency) of an attenuator 10-2 configured as a microstrip attenuator and designed to provide attenuation of 2 dB. S21 is the forward gain of the attenuator 10-2, which it is desired be constant at −2 dB over the frequency of interest. At 30 KHz, S21=−2.1361 dB. At 1 GHz, S21=−2.0143 dB. At 2 GHz, S21=−2.0728 dB. At 3GHz, S21=−2.1286 dB. Finally, at 4 GHz, S21=−2.0475 dB.

Figure 14B:
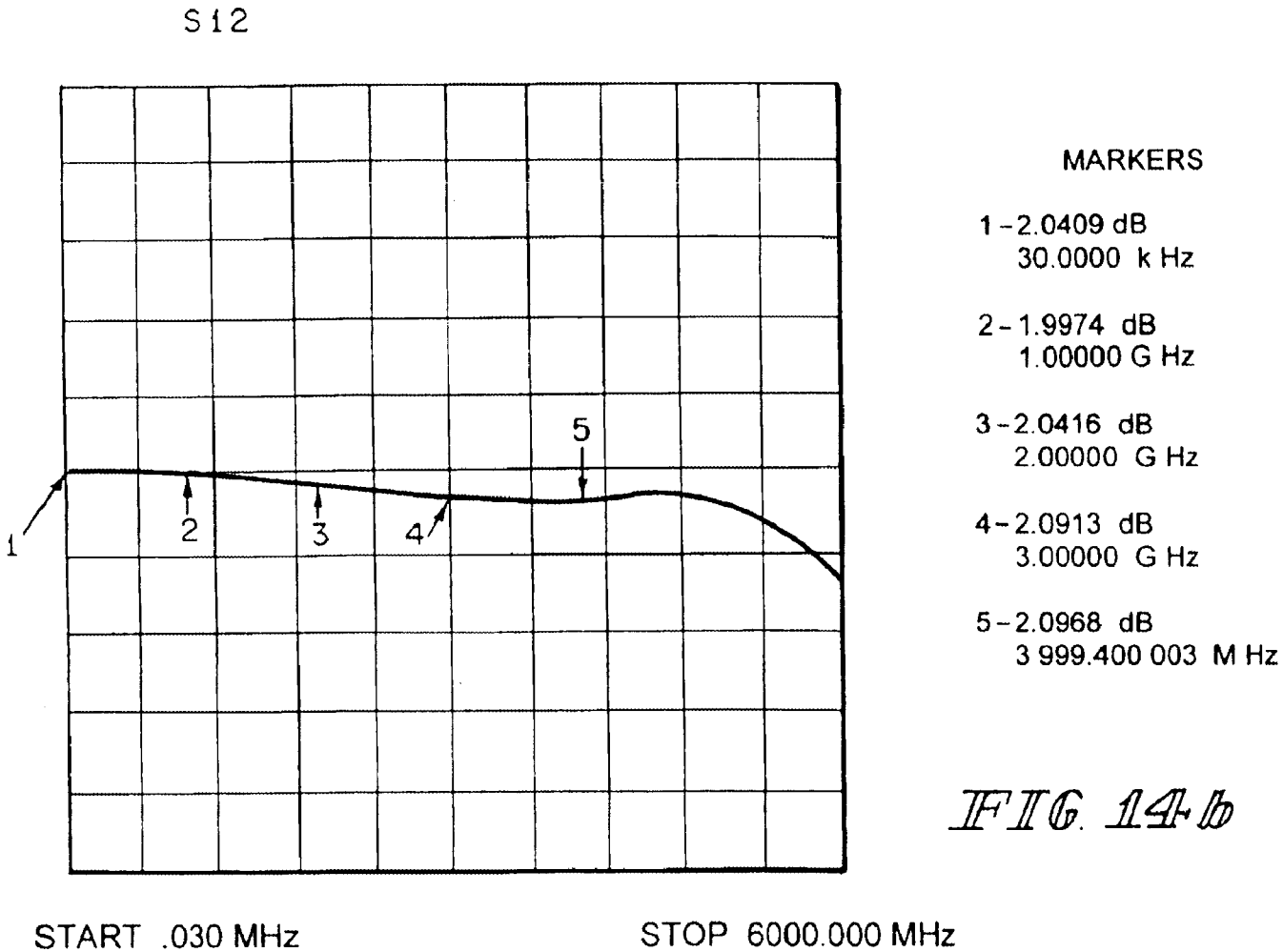

FIG. 14*b* illustrates a plot of S12 (in dB) versus $\log_{10}$ (frequency) of an attenuator 10-2 configured as a microstrip attenuator and designed to provide attenuation of 2 dB. At 30 KHz, S12=−2.0409 dB. At 1 GHz, S12=−1.9974 dB. At 2 GHz, S12=−2.0416 dB. At 3 GHz, S12=−2.0913 dB. Finally, at 4 GHz, S12=−2.0968 dB.

Figure 14C:
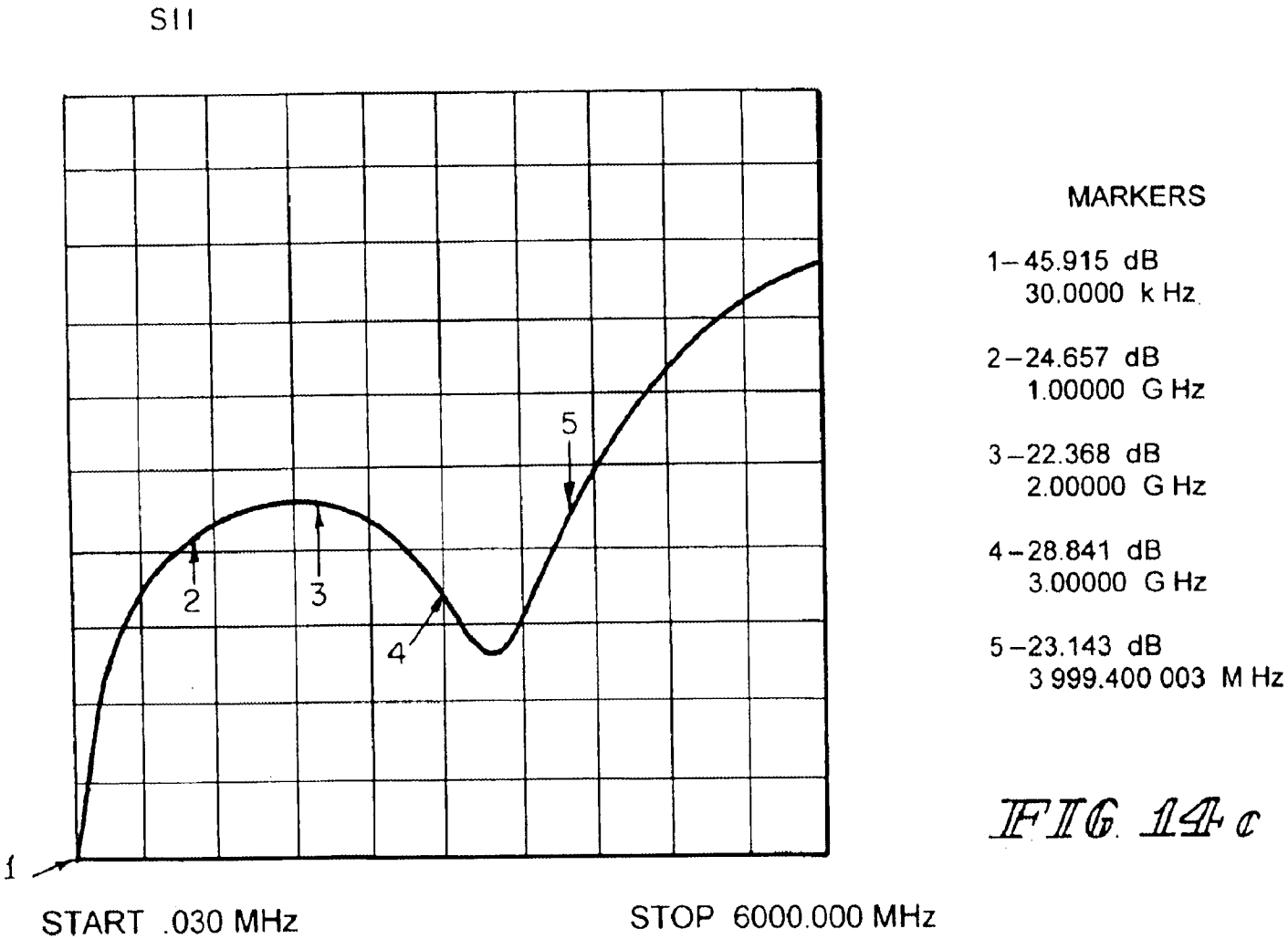

FIG. 14*c*illustrates a plot of S11 (in dB) versus $\log_{10}$ (frequency) of an attenuator 10-2 configured as a microstrip attenuator and designed to provide attenuation of 2 dB. At 30 KHz, S11=−45.915 dB. At 1 GHz, S11=−24.657 dB. At 2 GHz, S11=−22.368 dB. At 3 GHz, S11=−28.841 dB. Finally, at 4 GHz, S11=−23.143 dB.

FIG. 14*d* illustrates a plot of S22 (in dB) versus $\log_{10}$ (frequency) of an attenuator 10-2 configured as a microstrip attenuator and designed to provide attenuation of 2 dB. At 30 KHz, S22=−42.066 dB. At 1 GHz, S22=−24.799 dB. At 2 GHz, S22=−21.652 dB. At 3 GHz, S22=−22.309 dB. Finally, at 4 GHz, S22=−25.987 dB.

Figure 15A:
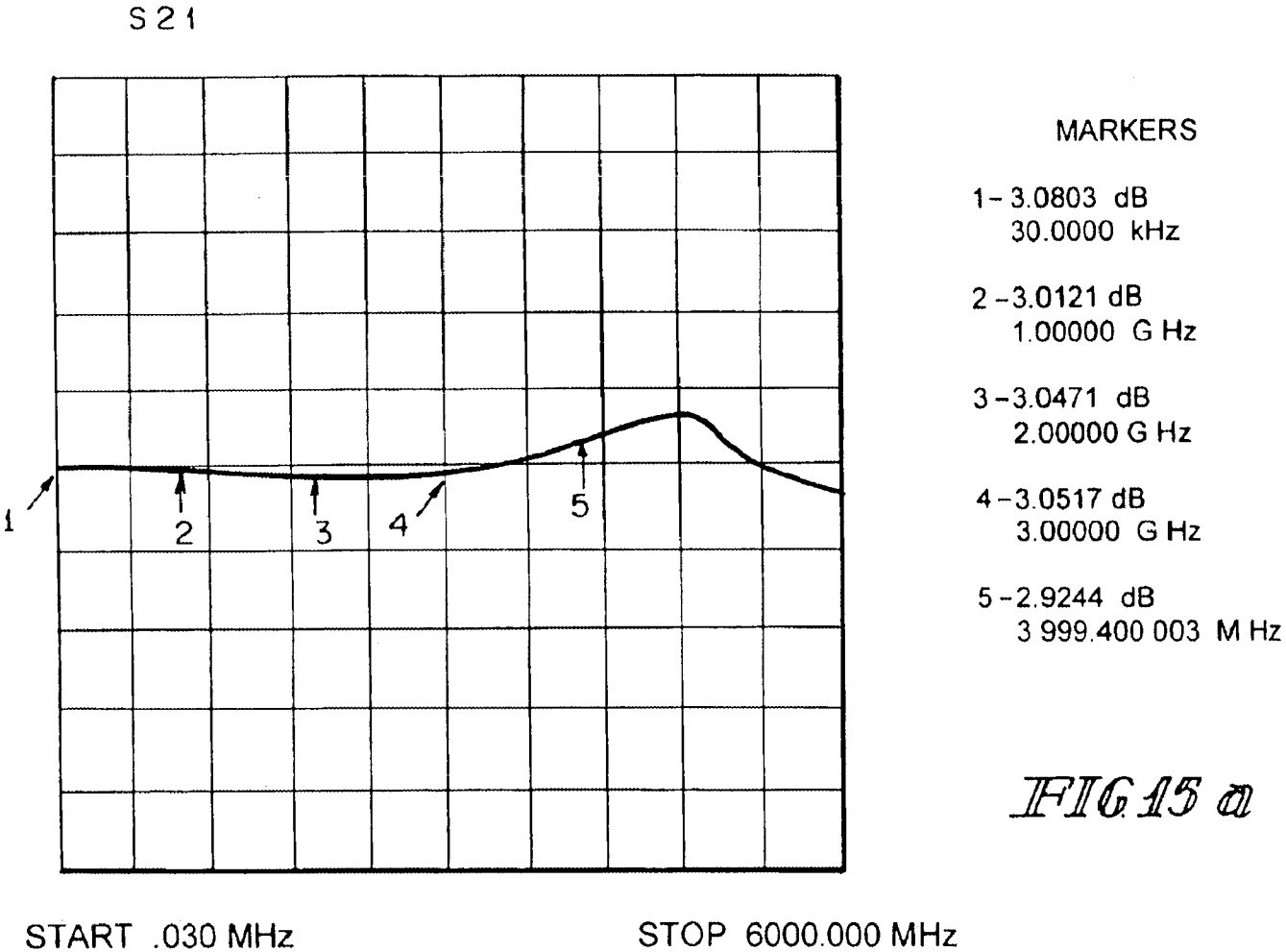

FIG. 15*a* illustrates a plot of S21 (in dB) versus $\log_{10}$ (frequency) of an attenuator 10-3 configured as a microstrip attenuator and designed to provide attenuation of 3 dB. S21 is the forward gain of the attenuator 10-3, which is desired be constant at −3 dB over the frequency of interest. At 30 KHz, S21=−3.0803 dB. At 1 GHz, S21=−3.0121 dB. At 2 GHz, S21=−3.047 dB. At 3 GHz, S21=−3.0517 dB. Finally, at 4GHz, S21=−2.9244 dB.

Figure 15B:
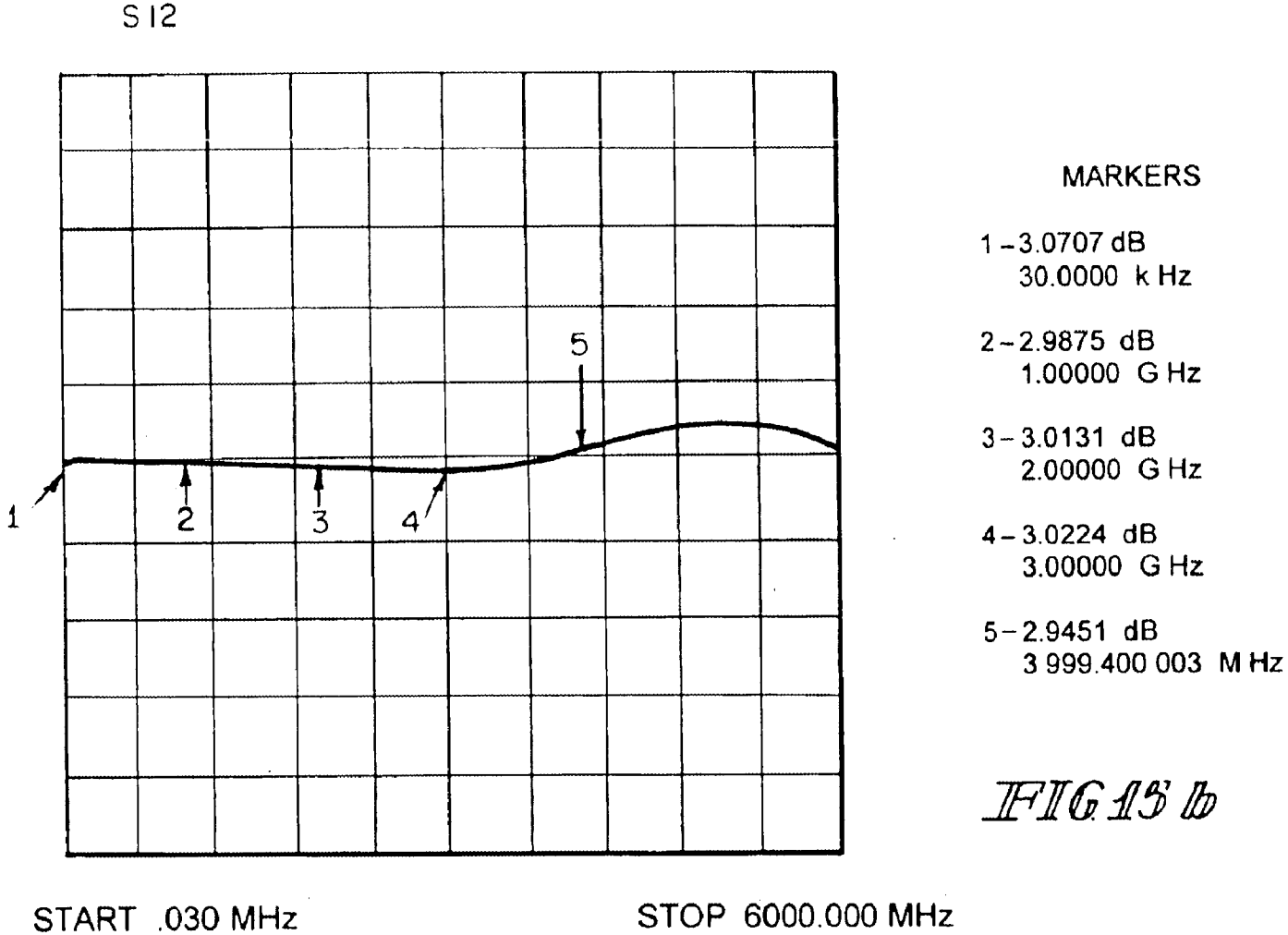

FIG. 15*b* illustrates a plot of S12 (in dB) versus $\log_{10}$ (frequency) of an attenuator 10-3 configured as a microstrip attenuator and designed to provide attenuation of 3 dB. At 30 KHz, S12=−3.0707 dB. At 1 GHz, S12=−2.9875 dB. At 2 GHz, S12=−3.0131 dB. At 3 GHz, S12=−3.0224 dB. Finally, at 4GHz, S12=−2.9451 dB.

Figure 15C:
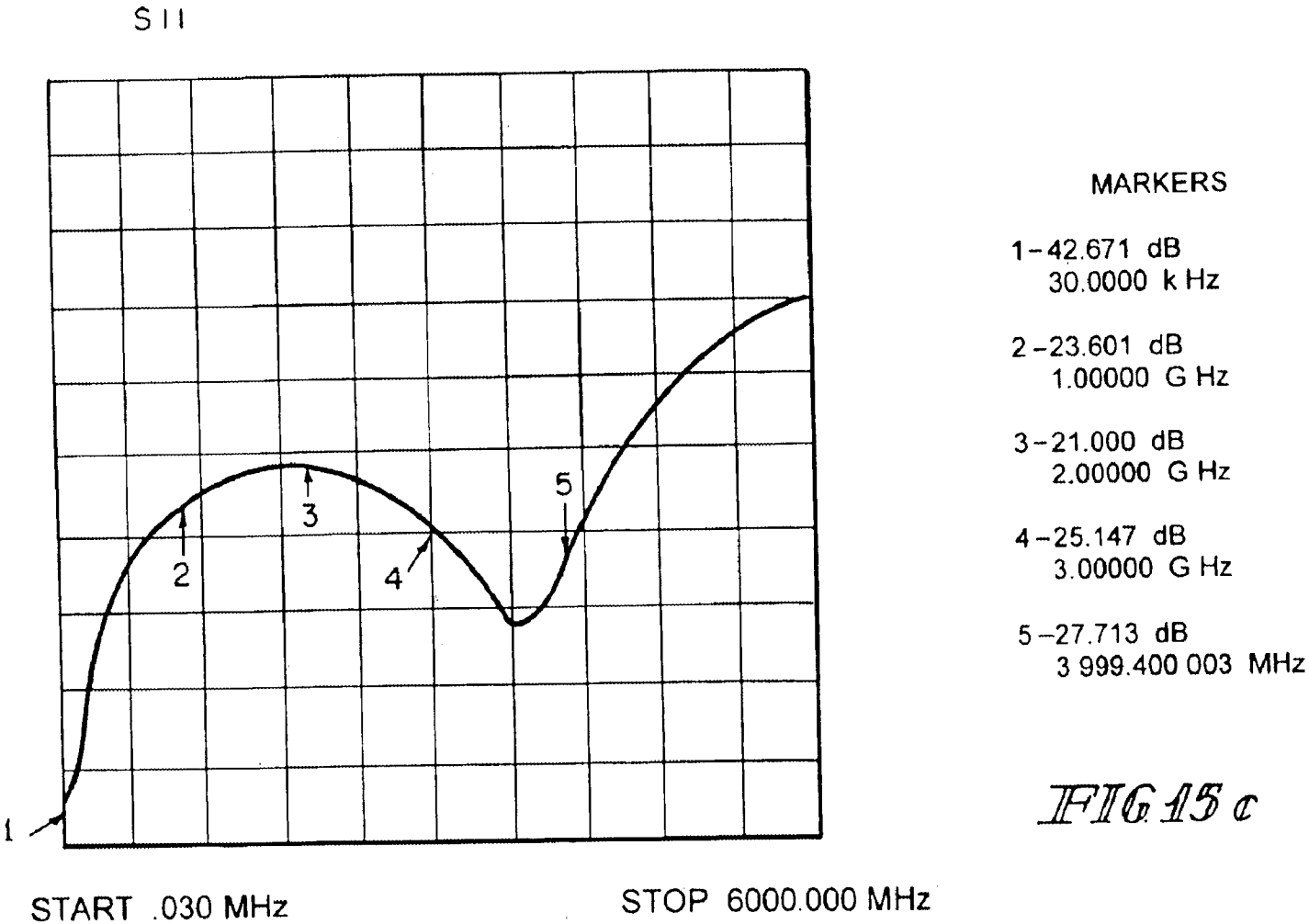

FIG. 15*c* illustrates a plot of S11 (in dB) versus $\log_{10}$ (frequency) of an attenuator 10-3 configured as a microstrip attenuator and designed to provide attenuation of 3 dB. At 30 KHz, S11=−42.671 dB. At 1 GHz, S11=−23.601 dB. At 2 GHz, S11=−21 dB. At 3 GHz, S11=−25.147 dB. Finally, at 4 GHz, S11=−27.713 dB.

Figure 15D:
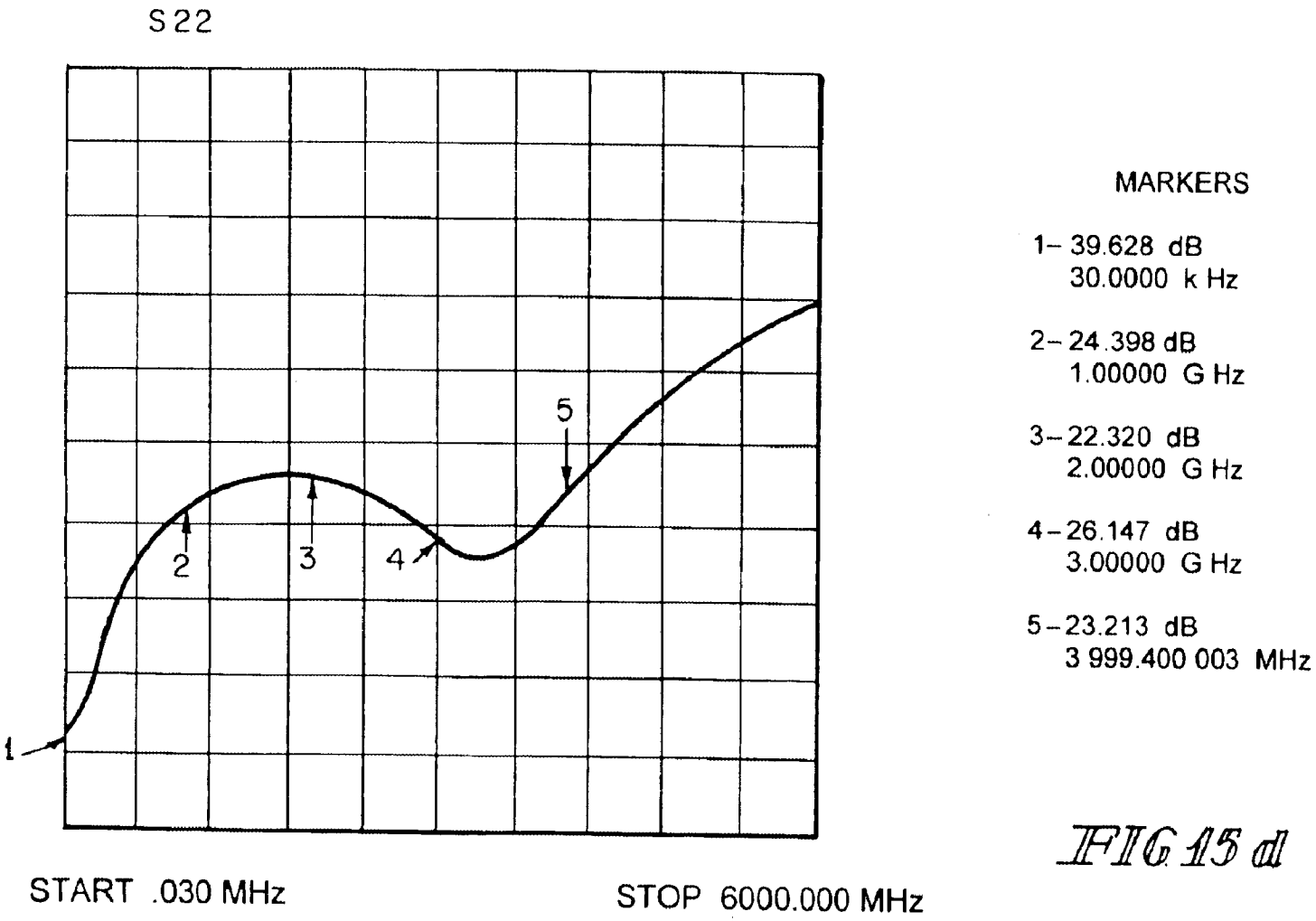

FIG. 15*d* illustrates a plot of S22 (in dB) versus $\log_{10}$ (frequency) of an attenuator 10-3 configured as a microstrip attenuator and designed to provide attenuation of 3 dB. At 30 GHz, S22=−39.628 dB. At 1 GHz, S22=−24.398 dB. At 2 GHz, S22=−22.320 dB. At 3 GHz, S22=−26.147 dB. Finally, at 4 GHz, S22=−23.213 dB.

Figure 16A:
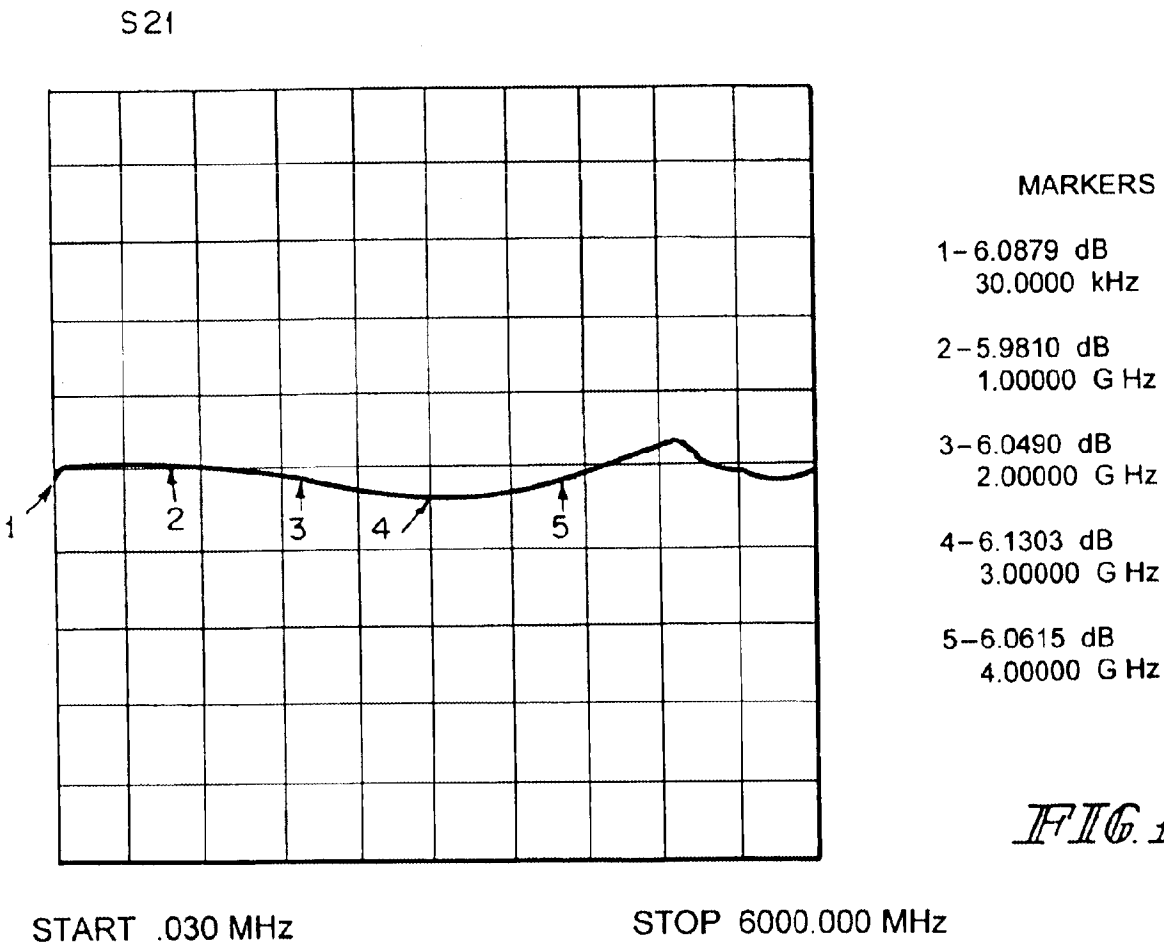

FIG. 16*a* illustrates a plot of S21 (in dB) versus $\log_{10}$ (frequency) of an attenuator 10-6 configured as a microstrip attenuator designed to provide attenuation of 6 dB. S21 is the forward gain of the attenuator 10-6, which it is desired be constant at −6 dB over the frequency of interest. At 30 KHz, S21=−6.0879 dB. At 1 GHz, S21 =−5.981 dB. At 2 GHz, S21=−6.049 dB. At 3 GHz, S21=−6.1303 dB. Finally, at 4 GHz, S21=−6.0615 dB.

Figure 16B:
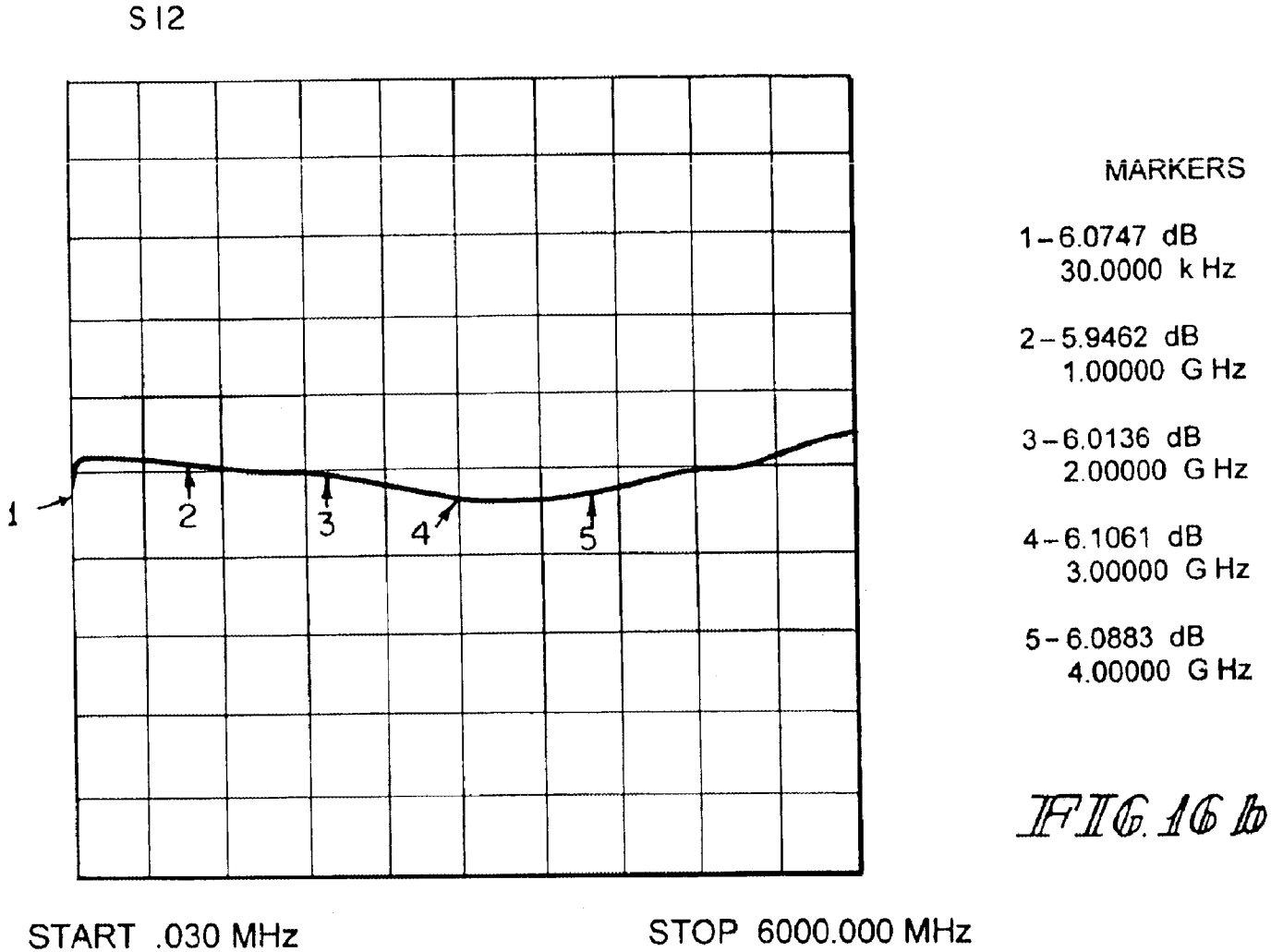

FIG. 16*b* illustrates a plot of S12 (in dB) versus $\log_{10}$ (frequency) of an attenuator 10-6 configured as a microstrip attenuator and designed to provide attenuation of 6 dB. At 30KHz, S12=−6.0747 dB. At 1GHz, S12=−5.9462 dB. At 2 GHz, S12=−6.0136 dB. At 3 GHz, S12=−6.1061 dB. Finally, at 4 GHz, S12=−6.0883 dB.

Figure 16C:
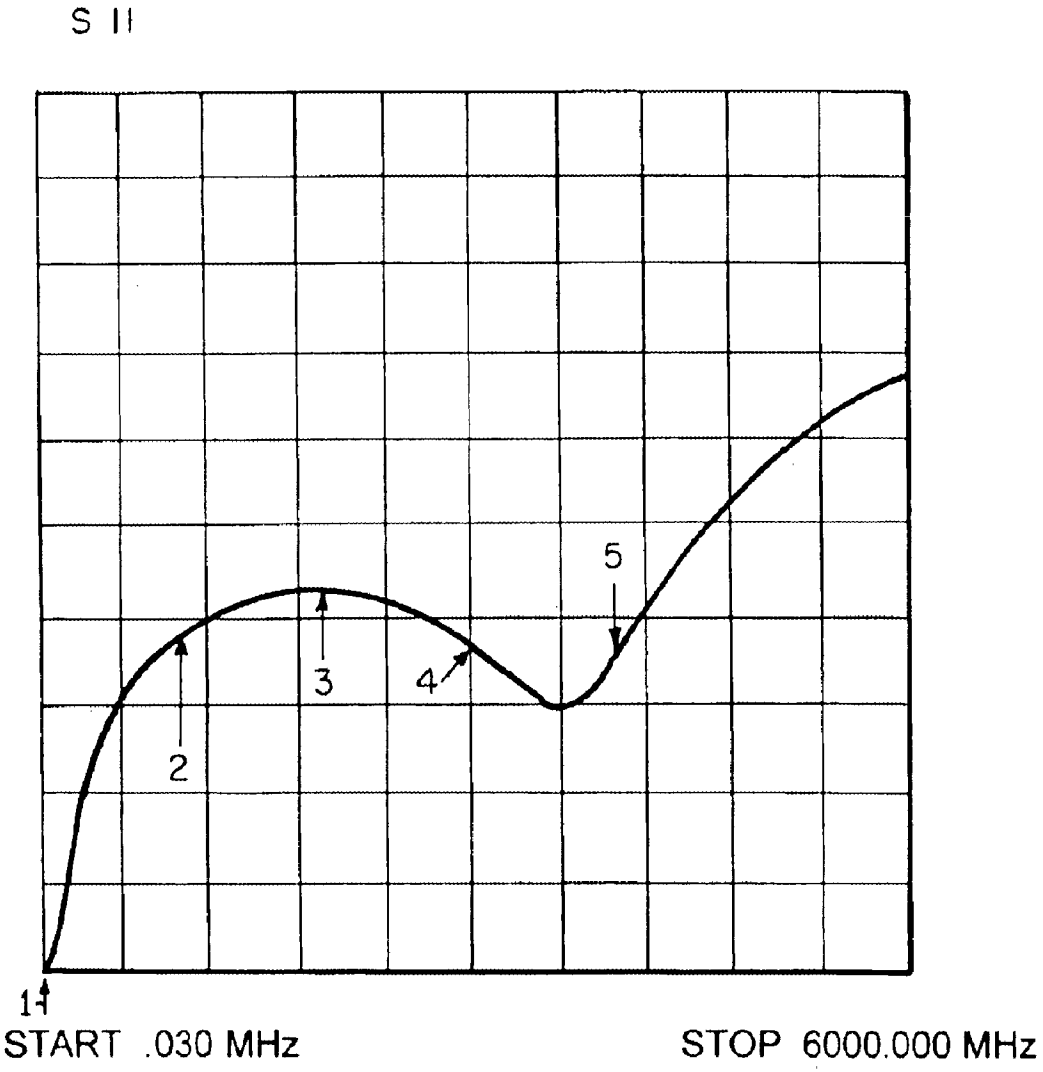

FIG. 16*c* illustrates a plot of S11 (in dB) versus $\log_{10}$ (frequency) of an attenuator 10-6 configured as a microstrip attenuator and designed to provide attenuation of 6 dB. At 30 KHz, S11=−45.340 dB. At 1GHz, S11=−26.116 dB. At 2 GHz, S11=−23.422 dB. At 3GHz, S11=−26.823 dB. Finally, at 4GHz, S11=−27.080 dB.

Figure 16D:
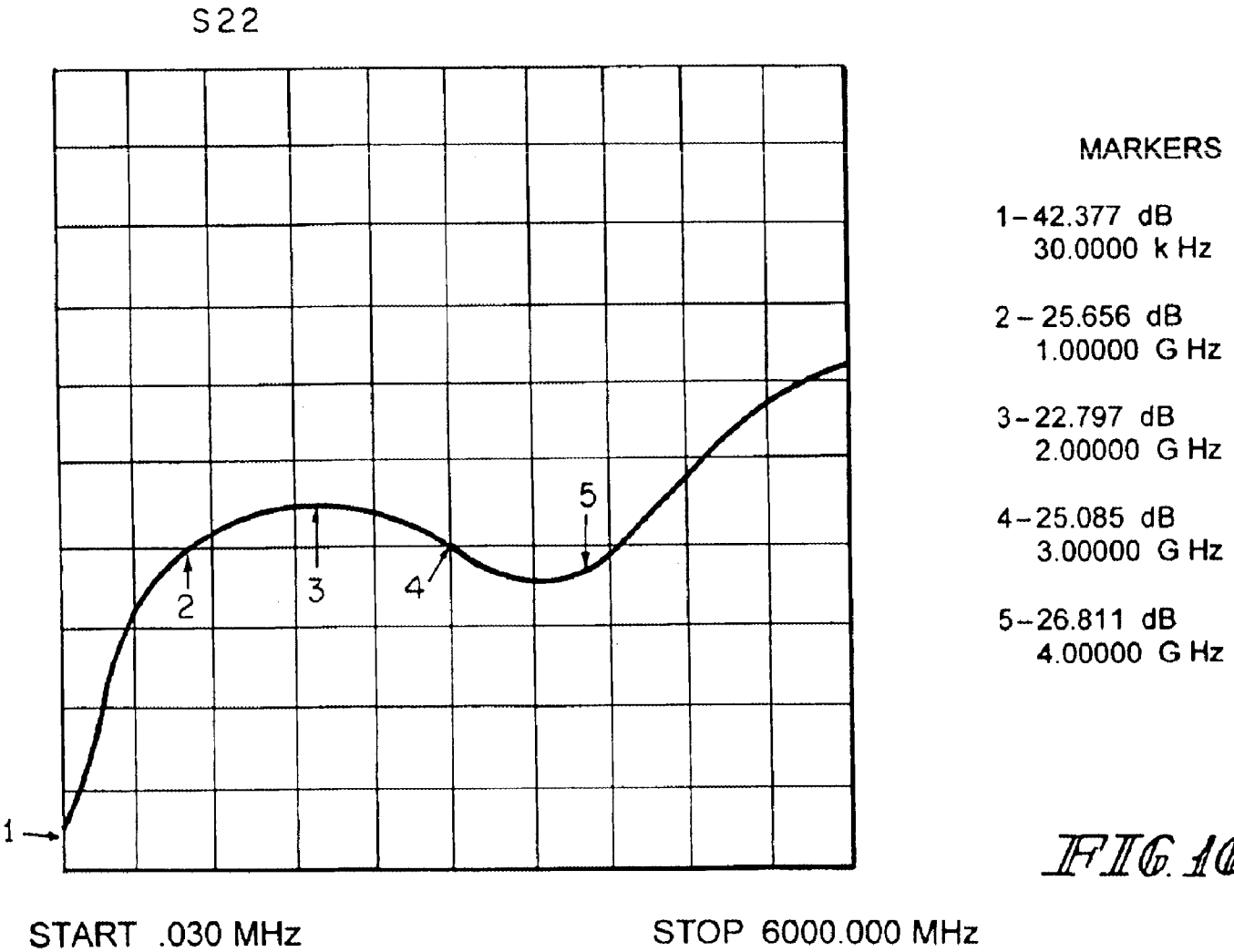

FIG. 16*d* illustrates a plot of S22 (in dB) versus $\log_{10}$ (frequency) of an attenuator 10-6 configured as a microstrip attenuator and designed to provide attenuation of 6 dB. At 30 KHz, S22=−42.377 dB. At 1 GHz, S22=−25.656 dB. At 2 GHz, S22=−22.797 dB. At 3 GHz, S22=−25.085 dB. Finally, at 4 GHz, S22=−26.811 dB.

FIG. 17*a* illustrates a plot of S21 (in dB) versus $\log_{10}$ (frequency) of an attenuator 10-10 configured as a microstrip attenuator and designed to provide attenuation of 10 dB. S21 is the forward gain of the attenuator 10-10, which it is desired to be constant at −10 dB over the frequency of interest. At 30 KHz, S21=−10.184 dB. At 1 GHz, S21=−9.9918 dB. At 2 GHz, S21=−9.9729 dB. At 3 GHz, S21=−10.003 dB. Finally, at 4 GHz, S21=−9.9386 dB.

Figure 17D:
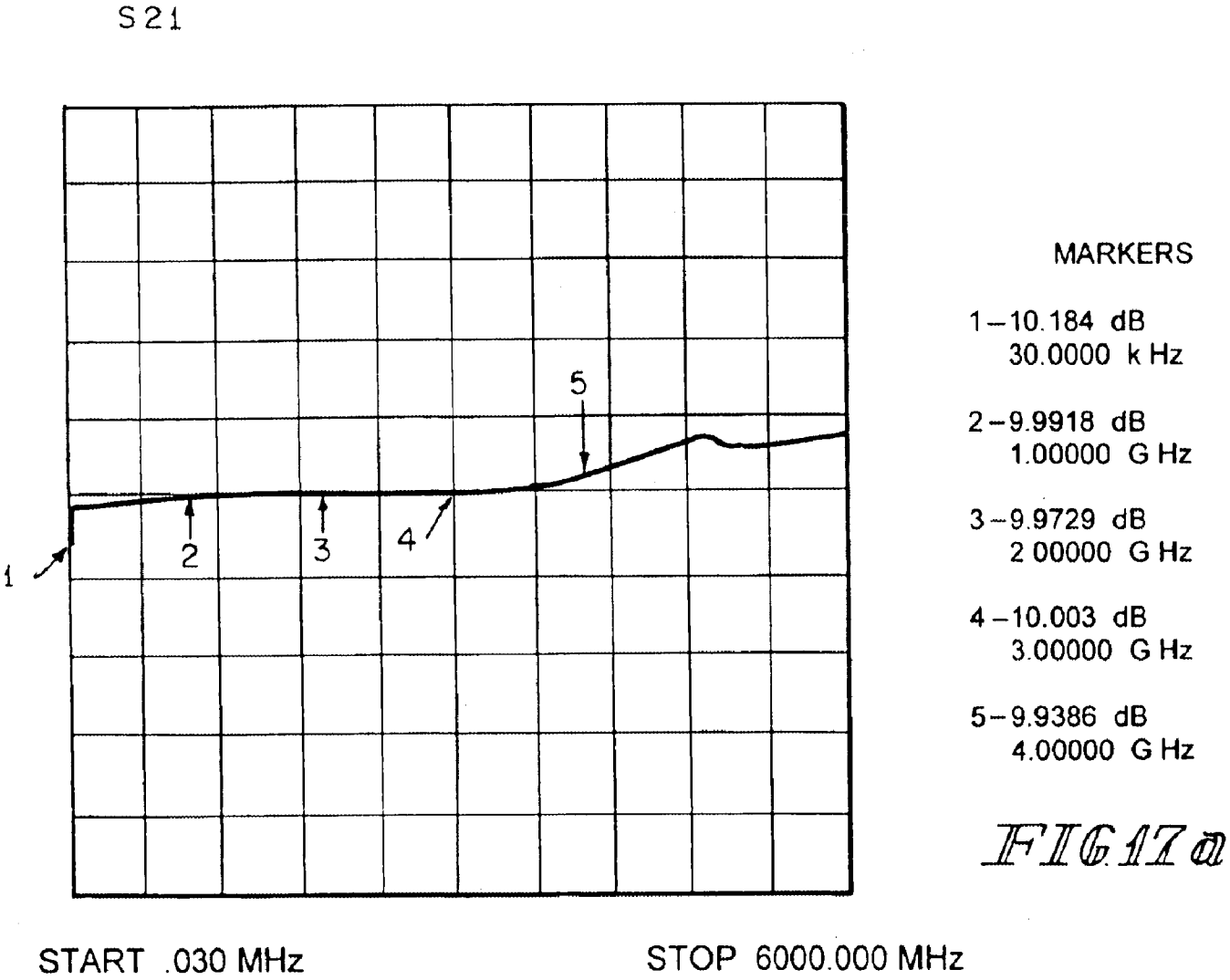
Figure 17B:
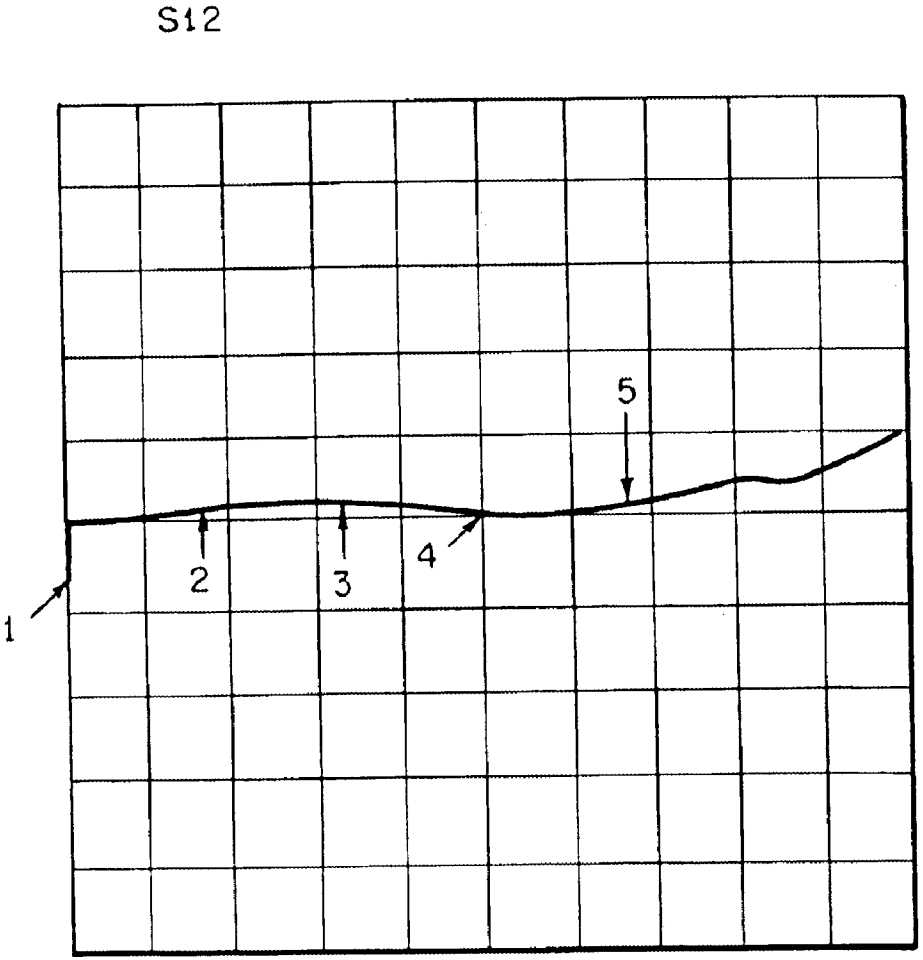
Figure 11C:
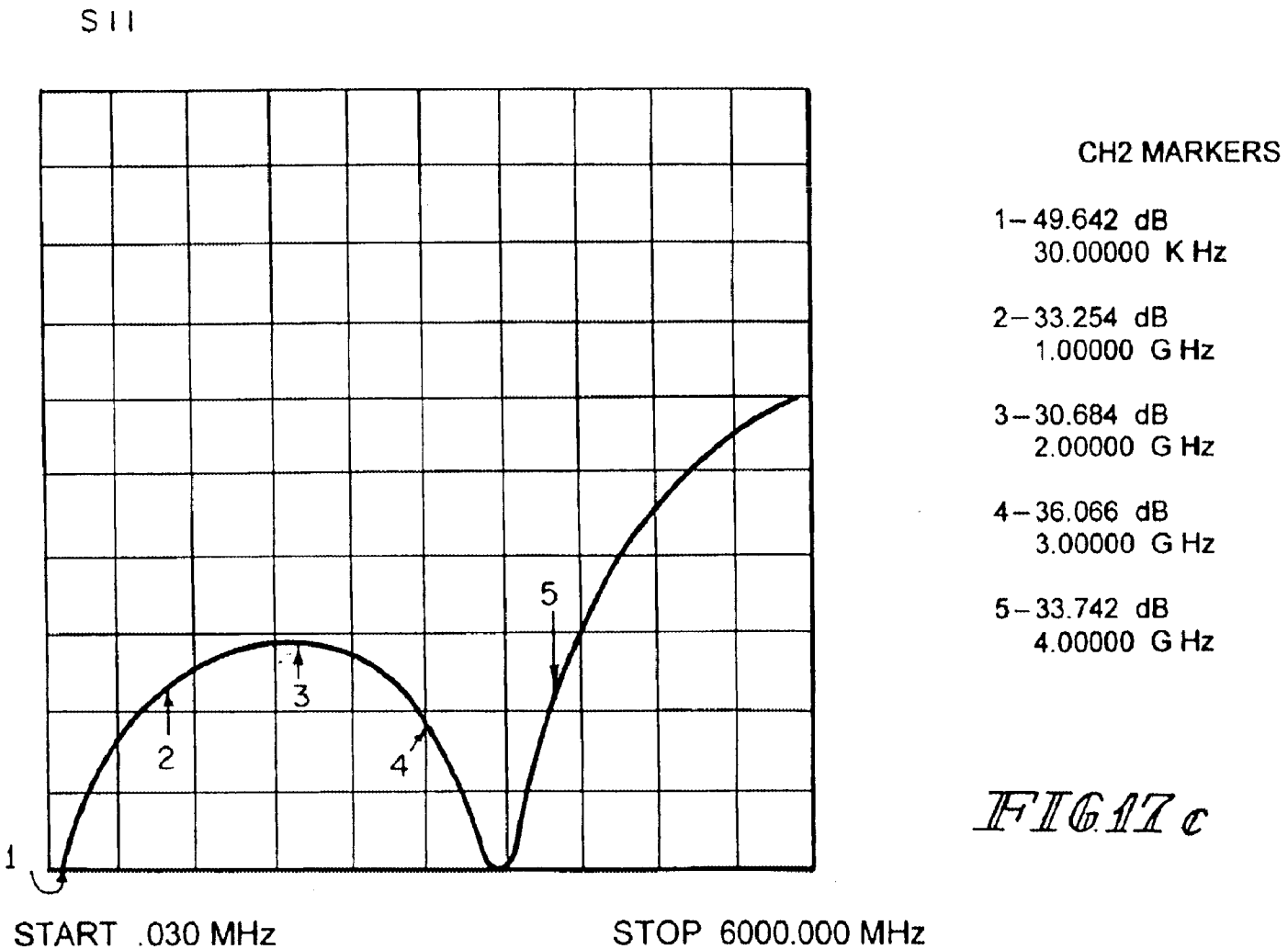
Figure 17D:
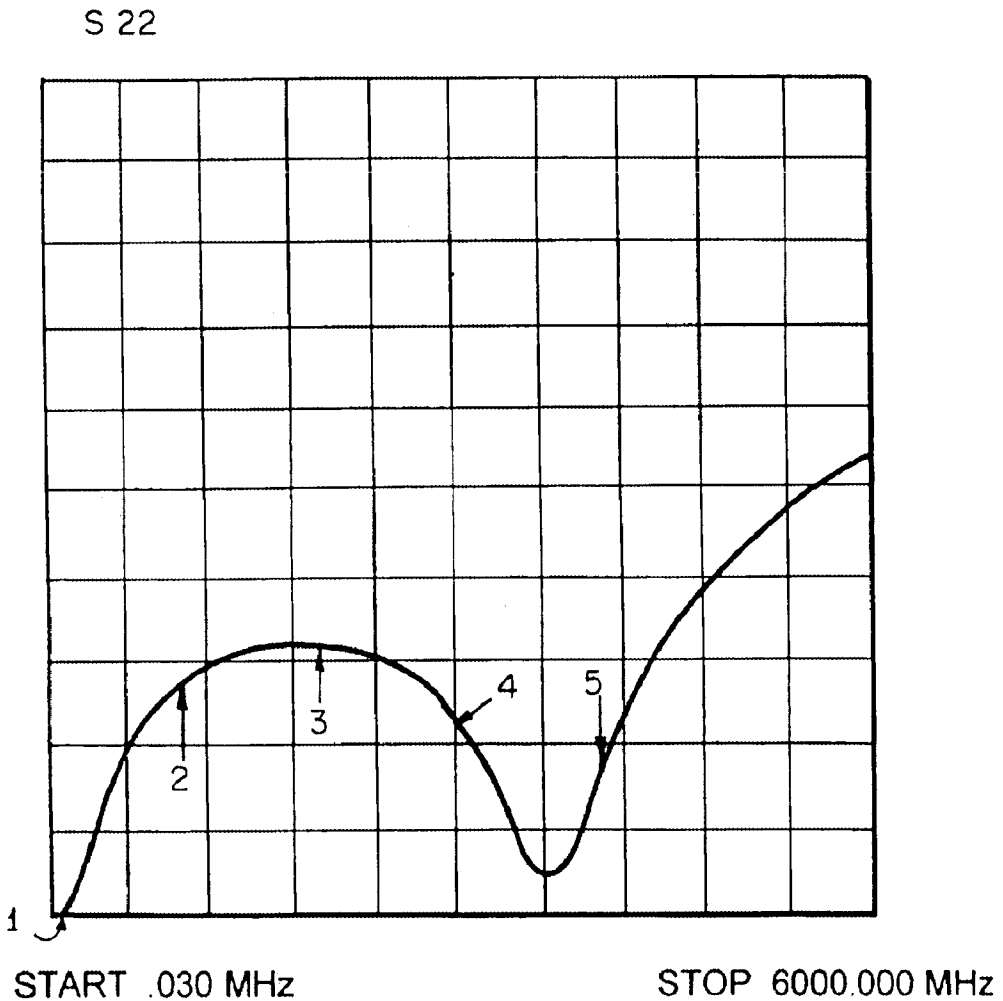

FIG. 17*d* illustrates a plot of S12 (in dB) versus $\log_{10}$ (frequency) of an attenuator 10-10 configured as a microstrip attenuator and designed to provide attenuation of 10 dB. At 30 KHz, S12=−10.172 dB. At 1 GHz, S12=−9.9506 dB. At 2 GHz, S12=−9.9415 dB. At 3 GHz, S12=−9.9895 dB. Finally, at 4 GHz, S12=−9.966 dB.

FIG. 17*c* illustrates a plot of S11 (in dB) versus $\log_{10}$ (frequency) of an attenuator 10-10 configured as a microstrip attenuator and designed to provide attenuation of 10 dB. At 30KHz, S11=−49.642 dB. At 1 GHz, S11=−33.254 dB. At 2 GHz, S11=−30.684 dB. At 3 GHz, S11=−36.066 dB. Finally, at 4 GHz, S11=−33.742 db.

FIG. 17*d* illustrates a plot of S22 (in dB) versus $\log_{10}$ (frequency)of an attenuator 10-10 configured as a microstrip attenuator and designed to provide attenuation of 10 dB. At 30KHz, S22=−46.615 dB. At 1GHz, S22=−31.574 dB. At 2 GHz, S22=−29.108 dB. At 3 GHz, S22=−33.744 dB. Finally, at 4 GHz, S22=−36.513 dB.

FIG. 18*a* illustrates a plot of S21 (in dB) versus $\log_{10}$ (frequency) of an attenuator 10-20 configured as a microstrip attenuator and designed to provide attenuation of 20 dB. S21 is the forward gain of the attenuator 10-20, which it is desired be constant at −20 dB over the frequency of interest. At 30 KHz, S21=−20.48 dB. At 1 GHz, S21=−20.041 dB. At 2 GHz, S21=−19.988 dB. At 3 GHz, S21=−19.966 dB. Finally, at 4 GHz, S21=−19.832 dB.

Figure 18D:
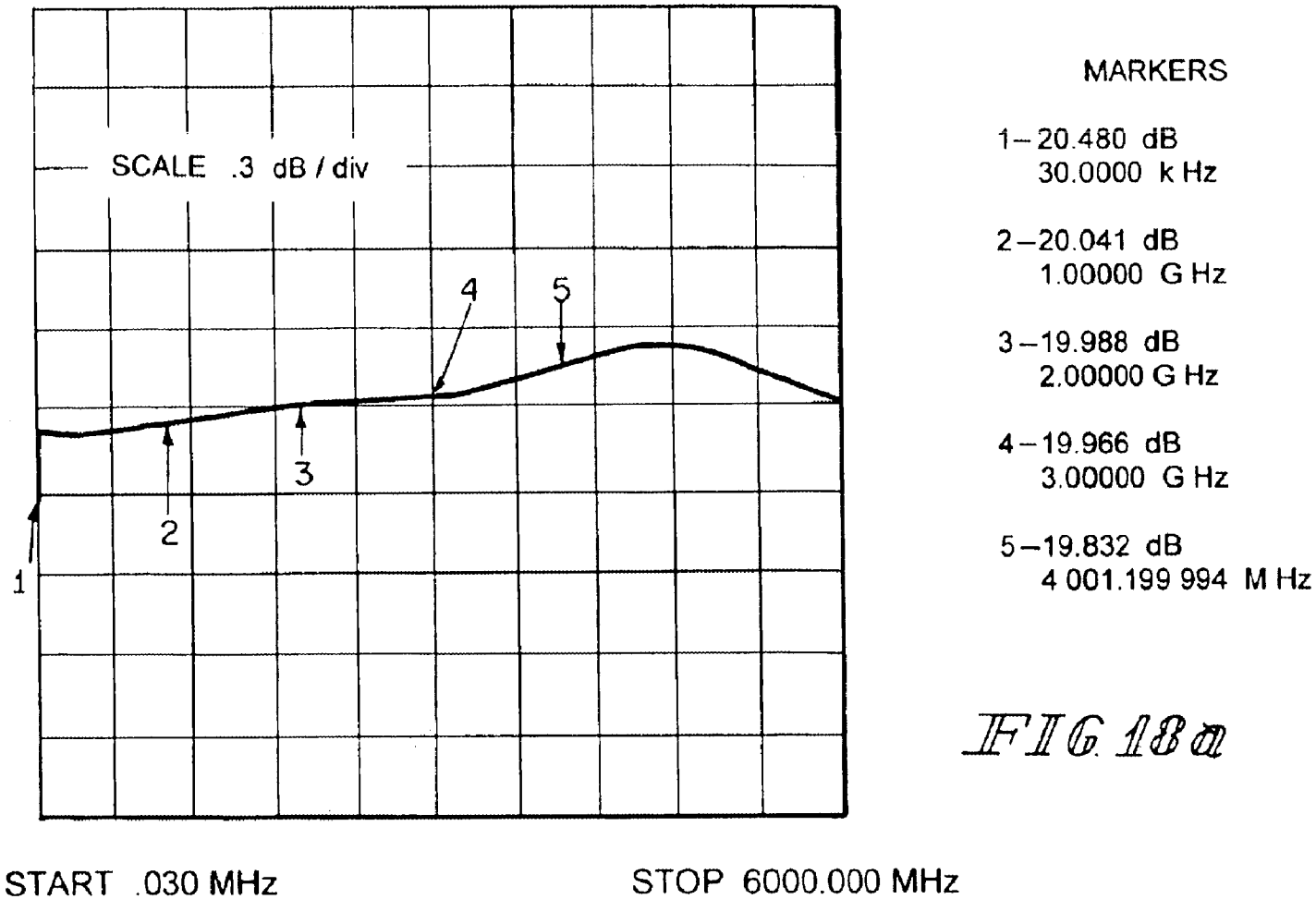
Figure 18B:
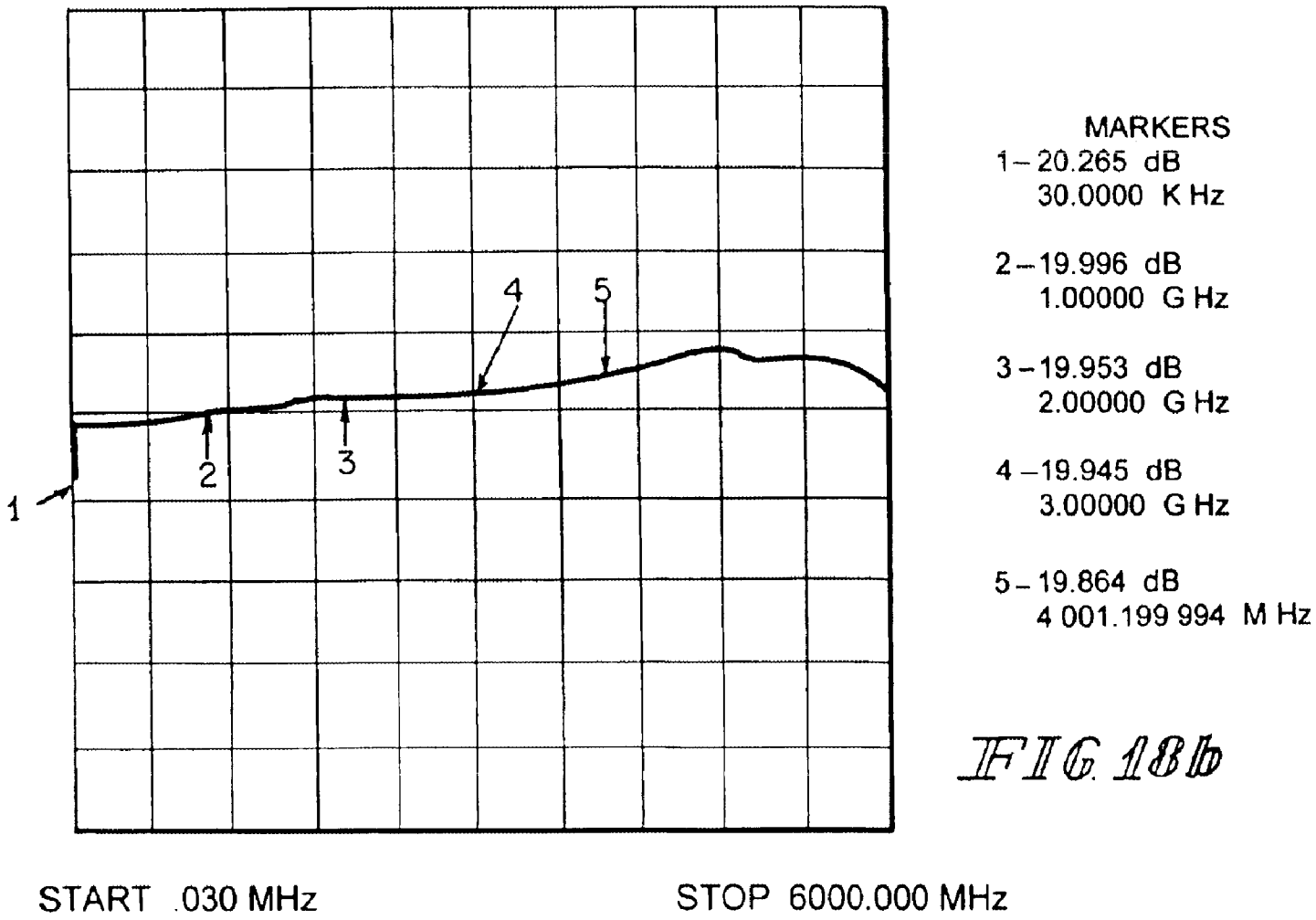

FIG. 18*b* illustrates a plot of S12 (in dB) versus $\log_{10}$ (frequency) of an attenuator 10-20 configured as a microstrip attenuator and designed to provide attenuation of 20 dB. At 30 KHz, S12=−20.265 dB. At 1 GHz, S12=−19.996 dB. At 2 GHz, S12=−19.953 dB. At 3 GHz, S12=−19.945 dB. Finally, at 4GHz, S12=−19.864 dB.

Figure 18C:
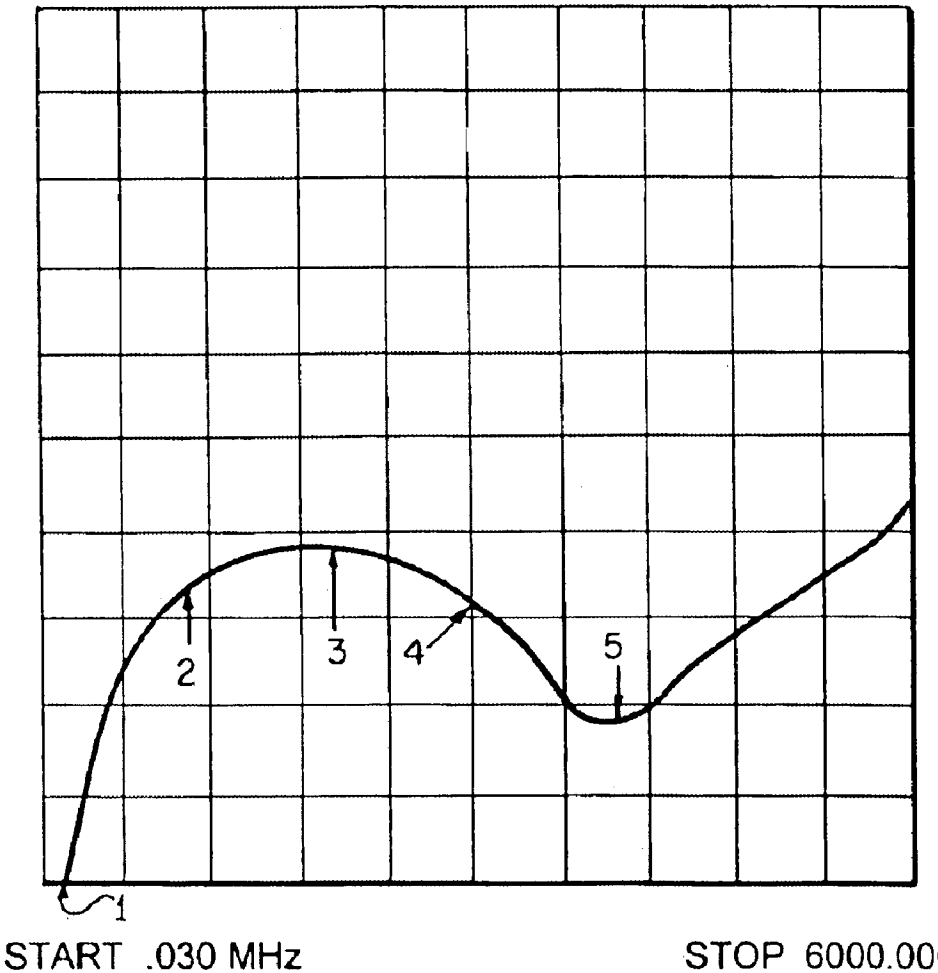
Figure 18D:
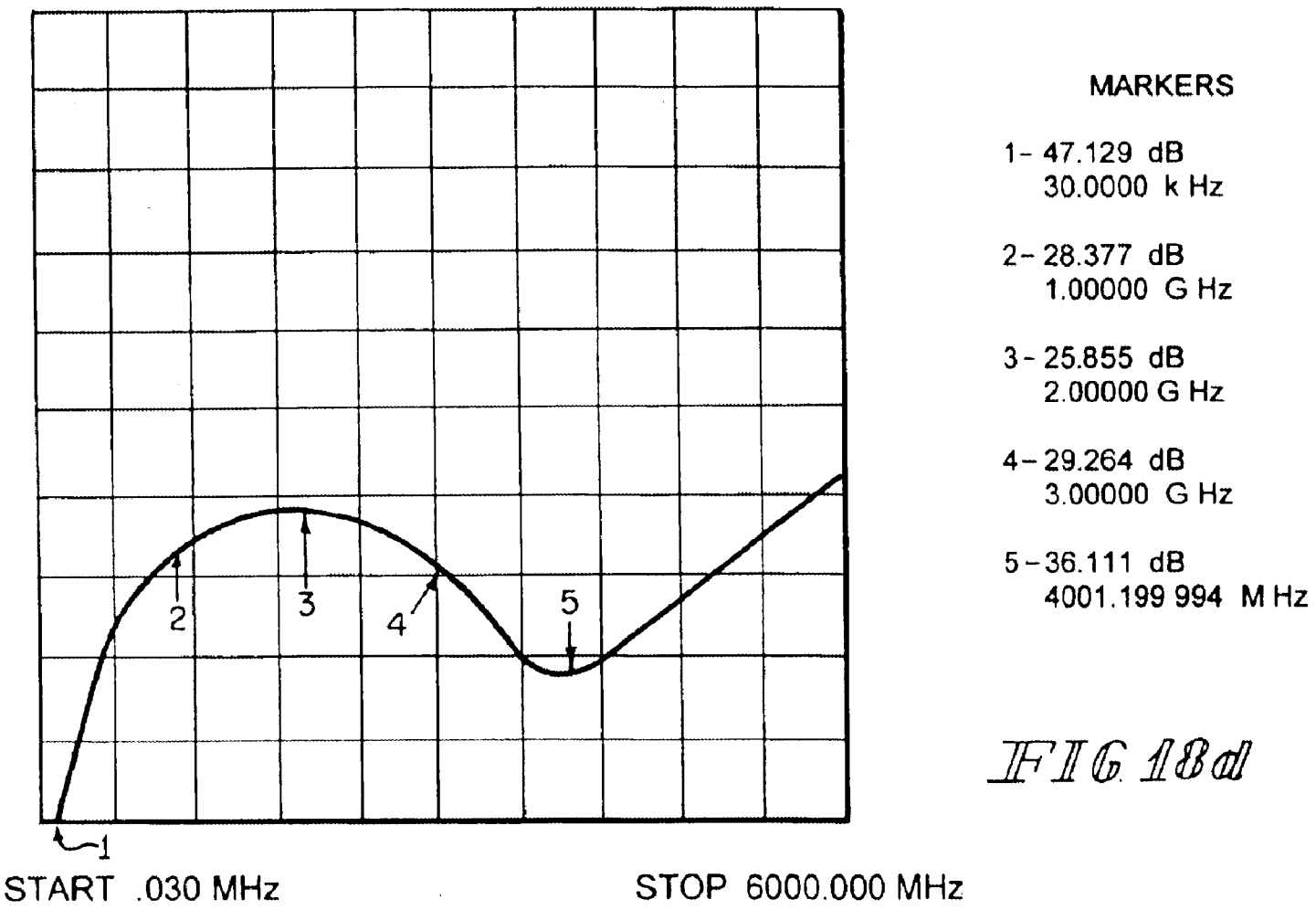

FIG. 18*c* illustrates a plot of S11 (in dB) versus $\log_{10}$ (frequency) of an attenuator 10-20 configured as a microstrip attenuator and designed to provide attenuation of 20 dB. At 30 KHz, S11=−48.33 dB. At 1GHz, S11=−28.27 dB. At 2 GHz, S11=−25.756 dB. At 3GHz, S11=−28.999 dB. Finally, at 4 GHz, S11=−36.378 dB.

FIG. 18*d* illustrates a plot of S22 (in dB) versus $\log_{10}$ (frequency) of an attenuator 10-20 configured as a microstrip attenuator and designed to provide attenuation of 20 dB. At 30 KHz, S22=−47.129 dB. At 1 GHz, S22=−28.377 dB. At 2 GHz, S22=−25.855 dB. At 3 GHz, S22=−29.264 dB. Finally, at 4 GHz, S22=−36.111 dB.

In the illustrated embodiments, the substrates 12 are constructed from, for example, hot air solder leveling (hereinafter sometimes HASL) plated GML 2000 laminate 0.031 inch (about 0.79 mm) thick, coated with copper to a uniform thickness providing 1 oz. (about 28.4 g) of copper on each side of an 18 inch (about 45.7 cm) by 24 inch (about 61 cm) sheet (about 102 g/m$^2$) of GML 2000 laminate. GML 2000 laminate is available form GIL Technologies, 175 Commerce Rd. Collierville, Tenn. 38017. The substrate 12 may also be constructed from, for example, HASL plated 25N laminate 0.030 inch (about 0.76 mm) thick, coated with copper to a uniform thickness providing 1 oz. (about 28.4 g) of copper on each side of an 18 inch (about 45.7 cm) by 24 inch (about 61 cm) sheet (about 102 g/m$^2$) of 25N laminate. 25N laminate is available from Arlon Corporation, 199 Amaral Street, East Providence, R.I. 02915

What is claimed is:

1. An attenuator including a substrate having first and second surfaces and a plurality of discrete circuit elements, the first surface including a first electrically conductive pattern providing circuit contacts providing electrical connections among the discrete circuit elements and circuit contacts providing electrical connections to components external to the attenuator, the second surface including a second electrically conductive pattern, and a housing for the attenuator, wherein the circuit contacts providing electrical connections to components external to the attenuator include connectors for coupling electrically to complementary connectors provided on the housing.

2. The apparatus of claim 1 wherein the housing includes a BNC connector and the circuit contacts include connectors for coupling electrically to respective terminals of the BNC connector.

3. The apparatus of claim 1 wherein the housing includes an SMA connector and the circuit contacts include connectors for coupling electrically to respective terminals of the SMA connector.

4. The apparatus of claim 1 wherein the substrate includes a third surface between the first and second surfaces, the third surface including an electrically conductive portion coupled to at least one of the first and second electrically conductive patterns, and further including a connector for coupling the electrically conductive portion of the third surface to the housing.

5. The apparatus of claim 2 wherein the substrate includes a third surface between the first and second surfaces, the third surface including an electrically conductive portion coupled to at least one of the first and second electrically conductive patterns, and further including a connector for coupling the electrically conductive portion of the third surface to the housing.

6. The apparatus of claim 3 wherein the substrate includes a third surface between the first and second surfaces, the third surface including an electrically conductive portion coupled to at least one of the first and second electrically conductive patterns, and further including means for coupling the electrically conductive portion of the third surface to the housing.

7. A microstrip attenuator including a substrate having first and second surfaces and a plurality of discrete circuit elements, the first surface including a first electrically conductive pattern providing circuit contacts providing electrical connections among the discrete circuit elements and circuit contacts providing electrical connections to components external to the attenuator, the second surface including a second electrically conductive pattern.

8. The apparatus of claim 1 wherein the attenuator comprises a microstrip attenuator.

9. The apparatus of claim 2 wherein the attenuator comprises a microstrip attenuator.

10. The apparatus of claim 3 wherein the attenuator comprises a microstrip attenuator.

11. The apparatus of claim 4 wherein the attenuator comprises a microstrip attenuator.

12. The apparatus of claim 5 wherein the attenuator comprises a microstrip attenuator.

13. The apparatus of claim 6 wherein the attenuator comprises a microstrip attenuator.

14. An attenuator including a fiber reinforced resin substrate having first and second surfaces and a plurality of discrete circuit elements, the first surface including a first electrically conductive pattern providing circuit contacts providing electrical connections among the discrete circuit elements and circuit contacts providing electrical connections to components external to the attenuator, the second surface including a second electrically conductive pattern.

15. The apparatus of claim 1 wherein the substrate comprises fiber-reinforced resin.

16. The apparatus of claim 2 wherein the substrate comprises fiber-reinforced resin.

17. The apparatus of claim 3 wherein the substrate comprises fiber-reinforced resin.

18. The apparatus of claim 4 wherein the substrate comprises fiber-reinforced resin.

19. The apparatus of claim 5 wherein the substrate comprises fiber-reinforced resin.

20. The apparatus of claim 6 wherein the substrate comprises fiber-reinforced resin.

21. The apparatus of claim 7 wherein the substrate comprises fiber-reinforced resin.

22. The apparatus of claim 8 wherein the substrate comprises fiber-reinforced resin.

23. The apparatus of claim 9 wherein the substrate comprises fiber-reinforced resin.

24. The apparatus of claim 10 wherein the substrate comprises fiber-reinforced resin.

25. The apparatus of claim 11 wherein the substrate comprises fiber-reinforced resin.

26. The apparatus of claim 12 wherein the substrate comprises fiber-reinforced resin.

27. The apparatus of claim 13 wherein the substrate comprises fiber-reinforced resin.

* * * * *